US010662981B2

(12) United States Patent
Suzuki et al.

(10) Patent No.: US 10,662,981 B2
(45) Date of Patent: May 26, 2020

(54) FLUID PRESSURE CYLINDER

(71) Applicant: SMC CORPORATION, Chiyoda-ku (JP)

(72) Inventors: Yasunaga Suzuki, Kasukabe (JP); Chiaki Fukui, Abiko (JP); Makoto Yaegashi, Tsukubamirai (JP)

(73) Assignee: SMC CORPORATION, Tokyo (JP)

( * ) Notice: Subject to any disclaimer, the term of this patent is extended or adjusted under 35 U.S.C. 154(b) by 31 days.

(21) Appl. No.: 15/580,106

(22) PCT Filed: Jun. 1, 2016

(86) PCT No.: PCT/JP2016/002635
§ 371 (c)(1),
(2) Date: Dec. 6, 2017

(87) PCT Pub. No.: WO2016/199373
PCT Pub. Date: Dec. 15, 2016

(65) Prior Publication Data

US 2018/0298926 A1 Oct. 18, 2018

(30) Foreign Application Priority Data

Jun. 11, 2015 (JP) ..... 2015-118182

(51) Int. Cl.
*F15B 15/14* (2006.01)
*F15B 15/22* (2006.01)

(52) U.S. Cl.
CPC ..... *F15B 15/1438* (2013.01); *F15B 15/226* (2013.01); *F15B 15/1447* (2013.01); *F15B 15/1461* (2013.01); *F15B 15/1471* (2013.01)

(58) Field of Classification Search
CPC ..... F15B 15/226; F15B 15/1438
(Continued)

(56) References Cited

U.S. PATENT DOCUMENTS 2,616,687 A 11/1952 Butterfield
3,136,225 A * 6/1964 Rader ..... F15B 15/223 91/395

(Continued)

FOREIGN PATENT DOCUMENTS

CH 643 638 A5 6/1984
CN 1272167 A 11/2000

(Continued)

OTHER PUBLICATIONS

Combined Chinese Office Action and Search Report dated Jan. 11, 2019 in Chinese Patent Application No. 201680033247.0 (with English translation), 12 pages.

(Continued)

*Primary Examiner* — Nathaniel E Wiehe
*Assistant Examiner* — Richard C Drake
(74) *Attorney, Agent, or Firm* — Oblon, McClelland, Maier & Neustadt, L.L.P.

(57) ABSTRACT

On inner wall surfaces of a head cover and a rod cover of a fluid pressure cylinder, respective pluralities of first and second spigot pins are installed to project out from the inner wall surfaces. The first and second spigot pins are disposed on circumferences of a predetermined diameter that internally contact or inscribe the cylinder tube. Further, when the cylinder tube is assembled with respect to the head cover and the rod cover, by the flange members of the first and second spigot pins inscribing the inner circumferential surface thereof, the cylinder tube is positioned and assembled coaxially with respect to the centers of the head cover and the rod cover.

4 Claims, 16 Drawing Sheets

(58) Field of Classification Search
USPC ..... 92/85 R, 168
See application file for complete search history.

(56) References Cited

U.S. PATENT DOCUMENTS

| | | | | |
|---|---|---|---|---|
| 3,175,474 | A | 3/1965 | Eickmann | |
| 3,655,204 | A | 4/1972 | Sievenpiper | |
| 3,835,753 | A * | 9/1974 | Bunyard | F01B 11/02 91/26 |
| 4,086,456 | A | 4/1978 | Bone | |
| 4,312,264 | A * | 1/1982 | Nunnemacher | F16J 10/02 92/161 |
| 4,370,918 | A | 2/1983 | Pringle | |
| 4,896,584 | A | 1/1990 | Stoll et al. | |
| 5,193,433 | A | 3/1993 | Reimer | |
| 5,241,896 | A * | 9/1993 | Braun | F01B 11/001 92/128 |
| 5,400,696 | A | 3/1995 | Weber | |
| 5,618,142 | A | 4/1997 | Sonden et al. | |
| 5,651,631 | A | 7/1997 | Carmien | |
| 6,038,959 | A * | 3/2000 | Sawada | F15B 15/1414 92/5 R |
| 6,186,484 | B1 | 2/2001 | Noda et al. | |
| 6,199,847 | B1 * | 3/2001 | Fukui | B25B 5/122 269/32 |
| 6,386,088 | B1 | 5/2002 | Yoshimoto et al. | |
| 9,038,527 | B2 | 5/2015 | Orihara et al. | |
| 9,410,624 | B2 | 8/2016 | George | |
| 2004/0107557 | A1 | 6/2004 | Morris et al. | |
| 2007/0048156 | A1 * | 3/2007 | Chung | F04B 35/045 417/417 |
| 2008/0173169 | A1 | 7/2008 | Ikari | |
| 2013/0032027 | A1 | 2/2013 | Orihara et al. | |
| 2014/0069271 | A1 | 3/2014 | Ishibashi et al. | |
| 2014/0076157 | A1 | 3/2014 | Fukui | |
| 2014/0157981 | A1 | 6/2014 | Saito et al. | |
| 2015/0267723 | A1 | 9/2015 | Kim | |
| 2016/0076559 | A1 | 3/2016 | Nomura | |
| 2016/0084220 | A1 * | 3/2016 | Moeller | F03D 13/20 33/533 |
| 2017/0191507 | A1 * | 7/2017 | Marinoni | F15B 15/1438 |

FOREIGN PATENT DOCUMENTS

| | | | |
|---|---|---|---|
| CN | 201170227 | Y | 12/2008 |
| CN | 201599273 | U | 10/2010 |
| CN | 103562567 | A | 2/2014 |
| DE | 81 24 287 | U1 | 12/1981 |
| DE | 199 25 600 | A1 | 12/2000 |
| DE | 101 41 560 | A1 | 3/2003 |
| DE | 10 2009 020 286 | A1 | 11/2010 |
| EP | 0 190 528 | A1 | 8/1986 |
| EP | 1 001 174 | A1 | 5/2000 |
| EP | 2716 920 | A1 | 4/2014 |
| FR | 2 575 527 | A1 | 7/1986 |
| JP | 48-14117 | Y1 | 4/1973 |
| JP | 50-152085 | | 12/1975 |
| JP | 52-27972 | | 3/1977 |
| JP | 52-125985 | A | 10/1977 |
| JP | 56-5605 | Y1 | 2/1981 |
| JP | 56-115010 | U | 9/1981 |
| JP | 59-1493 | U | 1/1984 |
| JP | 62-107103 | U | 7/1987 |
| JP | 63-111303 | A | 5/1988 |
| JP | 5-6204 | U | 1/1993 |
| JP | 5-59212 | U | 8/1993 |
| JP | 11-37112 | A | 2/1999 |
| JP | 11-62910 | A | 3/1999 |
| JP | 11-132204 | A | 5/1999 |
| JP | 11-153104 | A | 6/1999 |
| JP | 2000-074007 | A | 3/2000 |
| JP | 2005-54977 | A | 3/2005 |
| JP | 2007-16916 | A | 1/2007 |
| JP | 2008-133920 | A | 6/2008 |
| JP | 2012-57770 | A | 3/2012 |
| JP | 2014-219038 | A | 11/2014 |
| KR | 10-2014-0034198 | A | 3/2014 |
| KR | 10-2014-0074845 | A | 6/2014 |
| TW | M495452 | U | 2/2015 |
| WO | WO 2012/161159 | A1 | 11/2012 |
| WO | WO 2013/026508 | A1 | 2/2013 |

OTHER PUBLICATIONS

Combined Chinese Office Action and Search Report dated Dec. 26, 2018 in Chinese Patent Application No. 201680033635.9 (with English translation), 12 pages.
Combined Chinese Office Action and Search Report dated Dec. 27, 2018 in Chinese Patent Application No. 201680033652.2 (with English translation), 16 pages.
Combined Chinese Office Action and Search Report dated Jan. 16, 2019 in Chinese Patent Application No. 201680033671.5 (with English translation), 17 pages.
International Search Report and Written Opinion dated Oct. 7, 2016, in PCT/JP2016/002635 filed Jun. 1, 2016.
Office Action dated Mar. 18, 2019 in Korean Patent Application No. 10-2018-7000911, 8 pages (with unedited computer generated English translation).
Office Action dated Mar. 18, 2019 in Korean Patent Application No. 10-2018-7000913, 7 pages (with unedited computer generated English translation).
Office Action dated Mar. 18, 2019 in Korean Patent Application No. 10-2018-7000915, 7 pages (with unedited computer generated English translation).
Japanese Office Action dated Aug. 7, 2018 in Japanese Patent Application No. 2015-118190 (with English translation), 6 pages.
Japanese Office Action dated Aug. 7, 2018 in Japanese Patent Application No. 2015-118174 (with English translation), 9 pages.
Office Action dated Jan. 9, 2018 in Japanese Patent Application No. 2015-118174 (with English language translation).
Office Action dated Jan. 9, 2018 in Japanese Patent Application No. 2015-118182 (with English language translation).
Office Action dated Jan. 9, 2018 in Japanese Patent Application No. 2015-118190 (with English language translation).
Office Action dated Jun. 24, 2019, in co-pending U.S. Appl. No. 15/580,125, 13 pages.
Office Action dated May 14, 2019 in co-pending U.S. Appl. No. 15/580,109, 10 pages.
Office Action dated Jun. 10, 2019 in co-pending U.S. Appl. No. 15/580,124, 12 pages.
Office Action dated May 21, 2019 in co-pending U.S. Appl. No. 15/580,133, 15 pages.
Office Action dated Jun. 24, 2019 in co-pending U.S. Appl. No. 15/580,125, 12 pages.
Korean Office Action dated Aug. 5, 2019 in Korean Patent Application No. 10-2018-7000911 (with unedited computer generated English translation), 9 pages.
Combined Chinese Office Action and Search Report dated Aug. 14, 2019 in Chinese Patent Application No. 201680033045.6 (with English translation), 17 pages.
Office Action dated Aug. 8, 2019 in co-pending U.S. Appl. No. 15/580,098, 14 pages.
U.S. Office Action dated Nov. 4, 2019 in U.S. Appl. No. 15/580,125.
Office Action dated Jan. 1, 2020 issued in Indian Patent Application No. 201847000221 w/English Translation. 5 pages.
U.S. Appl. No. 15/580,098, filed Dec. 6, 2017, Yasunaga Suzuki, et al.
U.S. Appl. No. 15/580,109, filed Dec. 6, 2017, Yasunaga Suzuki, et al.
U.S. Appl. No. 15/580,125, filed Dec. 6, 2017, Yasunaga Suzuki, et al.
U.S. Appl. No. 15/580,133, filed Dec. 6, 2017, Yasunaga Suzuki, et al.

(56) References Cited

OTHER PUBLICATIONS

U.S. Appl. No. 15/580,124, filed Dec. 6, 2017, Yasunaga Suzuki, et al.

* cited by examiner

FLUID PRESSURE CYLINDER

TECHNICAL FIELD

The present invention relates to a fluid pressure cylinder that displaces a piston in an axial direction under the supply of a pressure fluid.

BACKGROUND ART

Conventionally, as a transport means for a workpiece or the like, for example, a fluid pressure cylinder having a piston that is displaced under the supply of a pressure fluid has been used. The present applicant has proposed a fluid pressure cylinder, as disclosed in Japanese Laid-Open Patent Publication No. 2008-133920, which is closed on both ends by a head cover and a rod cover, and in which the head cover and the rod cover are tightly fastened together with the cylinder tube by four connecting rods.

With this type of fluid pressure cylinder, a piston and a piston rod are disposed for displacement in the interior of the cylinder tube, and by supplying a pressure fluid into cylinder chambers that are formed between the piston and the cylinder tube, the piston is displaced along the axial directions.

SUMMARY OF INVENTION

A general object of the present invention is to provide a fluid pressure cylinder, which is capable of enhancing ease of assembly by easily and reliably carrying out positioning of the cylinder tube with respect to cover members.

The present invention is characterized by a fluid pressure cylinder comprising a tubular shaped cylinder tube including cylinder chambers defined in interior thereof, a cover member attached to an end of the cylinder tube, and a piston disposed displaceably along the cylinder chambers.

On an end surface of the cover member, a positioning member is provided that abuts against at least one of an inner wall surface or an outer wall surface of the cylinder tube, and positions the cylinder tube coaxially with respect to the cover member.

According to the present invention, on an end surface of the cover member of the fluid pressure cylinder, the positioning member is provided so as to abut against at least one of an inner wall surface or an outer wall surface of the cylinder tube, and position the cylinder tube coaxially with respect to the cover member. Thus, when the cylinder tube is assembled with respect to the cover member, by assembling the cylinder tube such that at least one of the inner wall surface and the outer wall surface thereof is made to abut against the positioning member, the cylinder tube can easily and reliably be positioned coaxially at a predetermined position with respect to the cover member. As a result, in the fluid pressure cylinder, it is possible to enhance ease of assembly of the cover member and the cylinder tube.

The above and other objects, features and advantages of the present invention will become more apparent from the following description when taken in conjunction with the accompanying drawings, in which a preferred embodiment of the present invention is shown by way of illustrative example.

DESCRIPTION OF EMBODIMENTS

Figure 1:
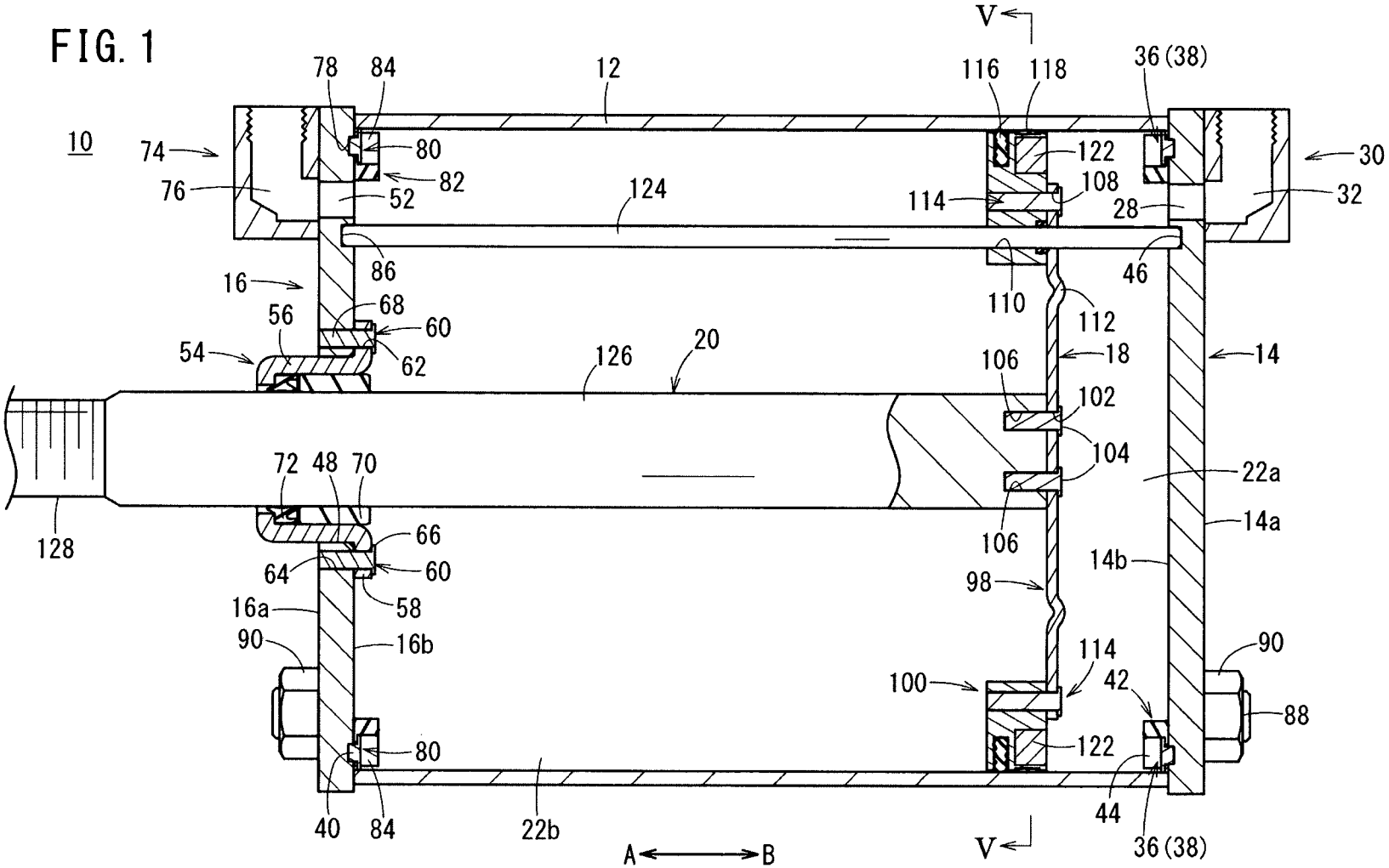
FIG. 1 is an overall cross-sectional view of a fluid pressure cylinder according to a first embodiment of the present invention.

As shown in FIG. 1, a fluid pressure cylinder 10 includes a tubular shaped cylinder tube 12, a head cover (cover member) 14 that is mounted on one end of the cylinder tube 12, a rod cover (cover member) 16 that is mounted on another end of the cylinder tube 12, a piston unit (piston) 18 that is disposed for displacement in the interior of the cylinder tube 12, and a piston rod 20 that is connected to the piston unit 18.

The cylinder tube 12, for example, is constituted from a cylindrical body that is formed from a metal material, and extends with a constant cross-sectional area along the axial direction (the directions of arrows A and B), and in the interior thereof there is provided a piston unit 18 that divides the interior into cylinder chambers 22*a*, 22*b*. Further, on both ends of the cylinder tube 12, ring shaped seal members (not shown) are installed respectively through annular grooves.

As shown in FIGS. 1 through 3A, 4A, and 7A, the head cover 14, for example, is a plate body that is formed with a substantially rectangular shape in cross section from a metal material, which is provided to cover one end of the cylinder tube 12. At this time, by the seal member (not shown), which is disposed on the end of the cylinder tube 12, abutting against the head cover 14, a pressure fluid is prevented from leaking out from the cylinder chamber 22*a* through a gap between the cylinder tube 12 and the head cover 14.

Figure 4A:
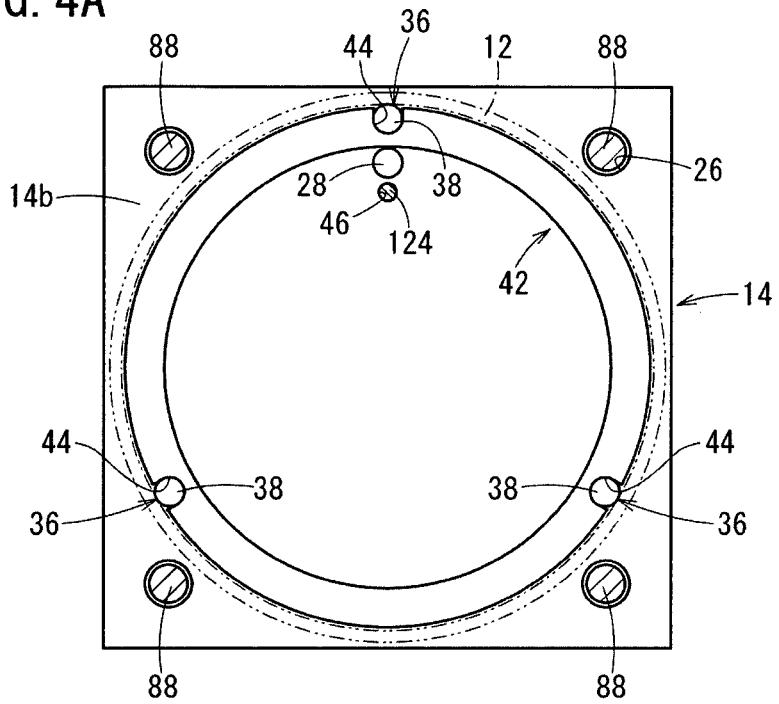
FIG. 4A is a front view shown partially in cross section of the head cover of FIG. 3A as seen from a side of the cylinder tube.
Figure 7A:
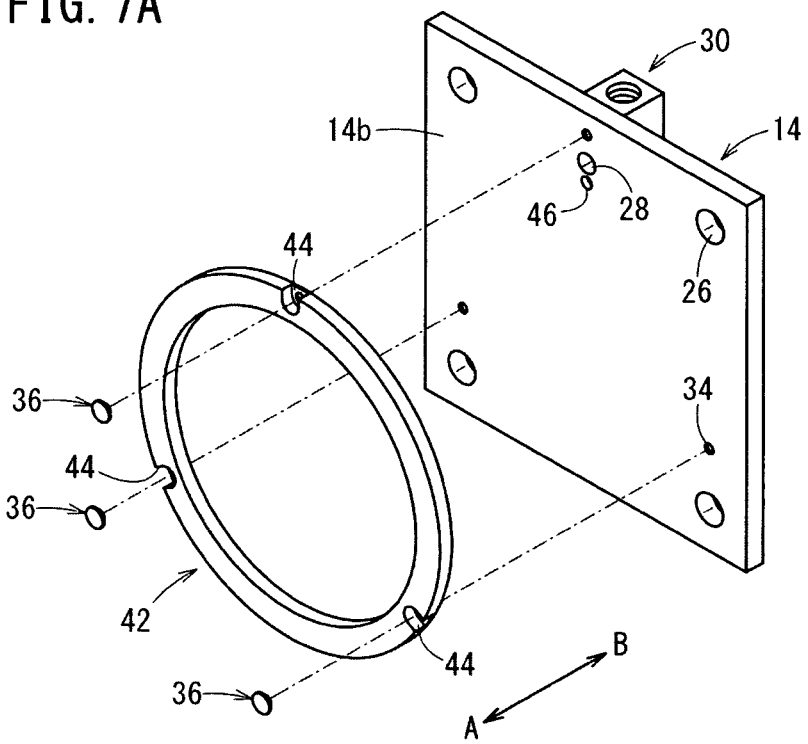
FIG. 7A is an exploded perspective view of a head cover and a first damper shown in FIG. 4A.

Further, as shown in FIGS. 4A and 7A, in the vicinity of the four corners of the head cover 14, four first holes 26 are formed, respectively, through which later-described connecting rods 88 are inserted. A first communication hole 28 is formed at a position on a central side of the head cover 14 with respect to the first holes 26. The first holes 26 and the first communication hole 28 penetrate respectively in a thickness direction (the directions of arrows A and B) of the head cover 14 shown in FIGS. 1 and 2.

A first port member 30 from which the pressure fluid is supplied and discharged is provided on an outer wall surface 14*a* of the head cover 14, to which a pressure fluid supply source is connected through a non-illustrated pipe. The first port member 30, for example, is constituted from a block body, which is formed from a metal material, and is fixed by welding or the like.

Further, in the interior of the first port member 30, a port passage 32, which is formed with an L-shape in cross-section, is formed, and an opening thereof is fixed with respect to the outer wall surface 14*a* of the head cover 14 in a state of being opened in a direction perpendicular to the axial direction of the cylinder tube 12.

In addition, by the port passage 32 of the first port member 30 communicating with the first communication hole 28 of the head cover 14, the first port member 30 and the interior of the cylinder tube 12 are placed in communication.

Instead of providing the first port member 30, for example, a pipe connection fitting may be connected directly with respect to the first communication hole 28.

On the other hand, on an inner wall surface 14*b* of the head cover 14 formed on a side of the cylinder tube 12 (in the direction of the arrow A), as shown in FIGS. 1, 2, 4A and 7A, a plurality of (for example, three) first pin holes 34 are formed on a circumference that is smaller in diameter than the inner circumferential diameter of the cylinder tube 12, and first spigot pins 36 (positioning members) are inserted respectively into the first pin holes 34. The first pin holes 34 are formed on a circumference having a predetermined diameter with respect to the center of the head cover 14, and are separated by equal intervals mutually along the circumferential direction.

The first spigot pins 36 are disposed in a plurality (three) so as to be of the same number as the first pin holes 34, and are made up from flange members 38 formed with circular shapes in cross section, and shaft members 40 of a smaller diameter than the flange members 38 which are inserted into the first pin holes 34. In addition, by press-fitting of the shaft members 40 of the first spigot pins 36 into the first pin holes 34, the first spigot pins 36 are fixed, respectively, to the inner wall surface 14*b* of the head cover 14, and the flange members 38 thereof are in a state of projecting out with respect to the inner wall surface 14*b* of the head cover 14.

Further, when the cylinder tube 12 is assembled with respect to the head cover 14, as shown in FIG. 4A, the outer circumferential surfaces of the flange members 38 of the first spigot pins 36 come into internal contact with, i.e., inscribe, respectively, the inner circumferential surface of the cylinder tube 12, whereby the cylinder tube 12 is positioned with respect to the head cover 14. More specifically, the plural first spigot pins 36 function as positioning means for positioning the one end of the cylinder tube 12 coaxially with respect to the head cover 14.

Stated otherwise, the first spigot pins 36 are arranged on a circumference having a predetermined diameter so that the outer circumferential surfaces thereof internally contact or inscribe the inner circumferential surface of the cylinder tube 12.

A ring shaped first damper 42 is disposed on the inner wall surface 14*b* of the head cover 14. The first damper 42, for example as shown in FIGS. 4A and 7A, is formed with a predetermined thickness from a resilient material such as rubber or the like, and the inner circumferential surface thereof is arranged more radially outward than the first communication hole 28 (see FIGS. 2 and 4A).

Figure 2:
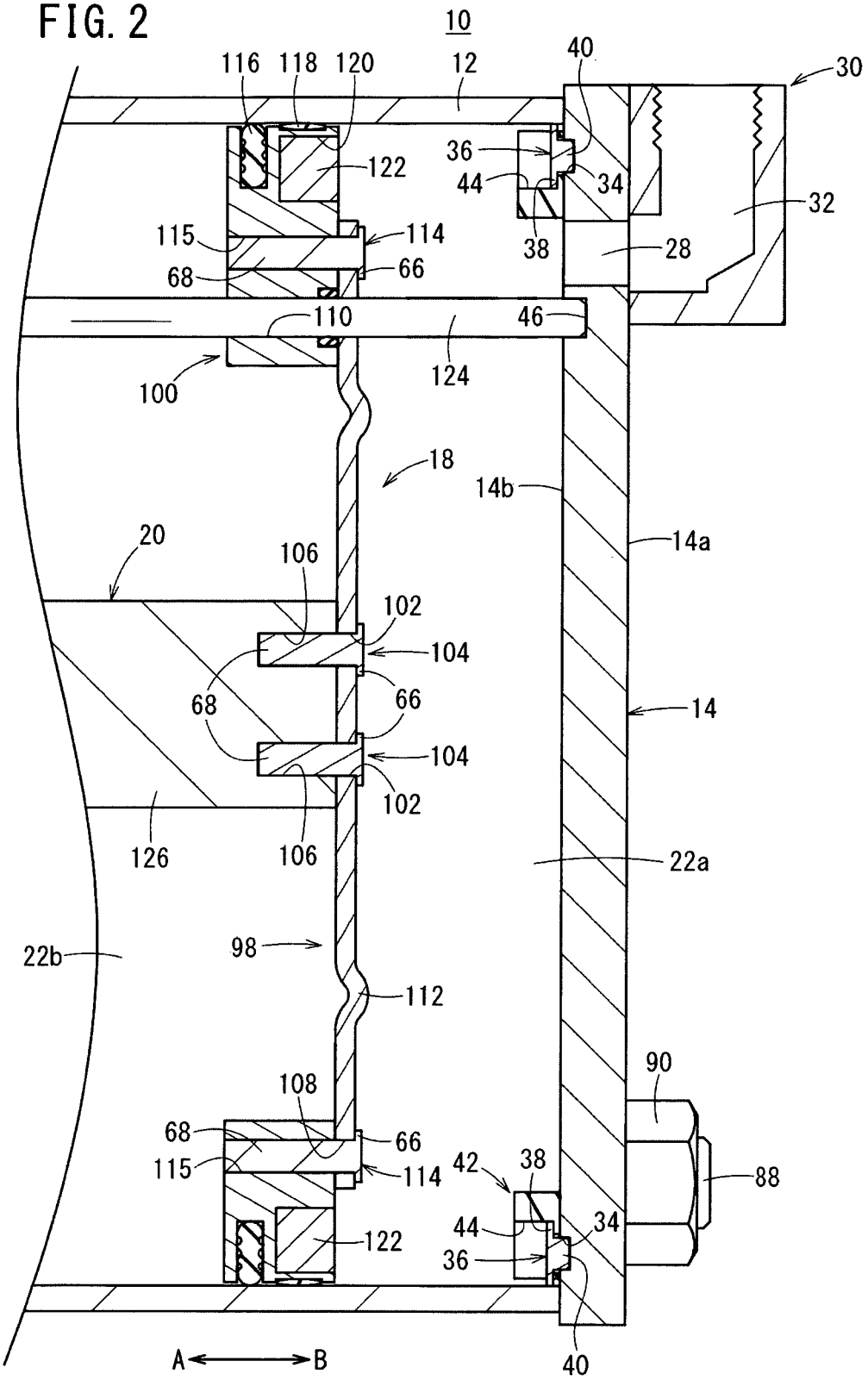
FIG. 2 is an enlarged cross-sectional view of the vicinity of a piston unit in the fluid pressure cylinder of FIG. 1.

Further, in the first damper 42, plural cutaway sections 44 are included, which are recessed with substantially circular shapes in cross section radially inward from the outer circumferential surface of the first damper 42, and the first spigot pins 36 are inserted through the cutaway sections 44. More specifically, the cutaway sections 44 are provided in the same number, at the same pitch, and on the same circumference as the first spigot pins 36. In addition, as shown in FIG. 2, by the first damper 42 being sandwiched between the inner wall surface 14*b* of the head cover 14 and the flange members 38 of the first spigot pins 36, the first damper 42 is retained in a state of projecting out at a predetermined height with respect to the inner wall surface 14*b*.

More specifically, at the same time as functioning as positioning means (spigot means) for positioning the one end of the cylinder tube 12 at a predetermined position with respect to the head cover 14, the first spigot pins 36 also function as fixing means for fixing the first damper 42 to the head cover 14.

In addition, when the piston unit 18 is displaced to the side of the head cover 14 (in the direction of the arrow B), by the end thereof coming into abutment against the first damper 42, direct contact between the piston unit 18 and the head cover 14 is avoided, and the occurrence of shocks and impact noises accompanying such contact is suitably prevented.

Further, a first rod hole 46 in which a later-described guide rod 124 is supported is formed in the head cover 14 at a position located further toward the central side with respect to the first communication hole 28. The first rod hole 46 opens toward the side of the inner wall surface 14*b* of the head cover 14 (in the direction of the arrow A) and does not penetrate through to the outer wall surface 14*a*.

As shown in FIGS. 1, 3B, 4B, 6, and 7B, the rod cover 16, in the same manner as the head cover 14, for example, is a plate body that is formed with a substantially rectangular shape in cross section from a metal material, which is provided to cover the other end of the cylinder tube 12. At this time, by the seal member (not shown), which is disposed on the end of the cylinder tube 12, abutting against the rod cover 16, the pressure fluid is prevented from leaking out from the cylinder chamber 22*b* through a gap between the cylinder tube 12 and the rod cover 16.

A rod hole 48 is formed to penetrate in an axial direction (the directions of arrows A and B) through the center of the rod cover 16, and four second holes 50 through which the later-described connecting rods 88 are inserted are formed in the four corners of the rod cover 16. Further, a second communication hole 52 is formed in the rod cover 16 at a position located on the central side with respect to the second holes 50. The rod hole 48, the second holes 50, and the second communication hole 52 are formed to penetrate respectively in the thickness direction (the directions of arrows A and B) through the rod cover 16.

Figure 6:
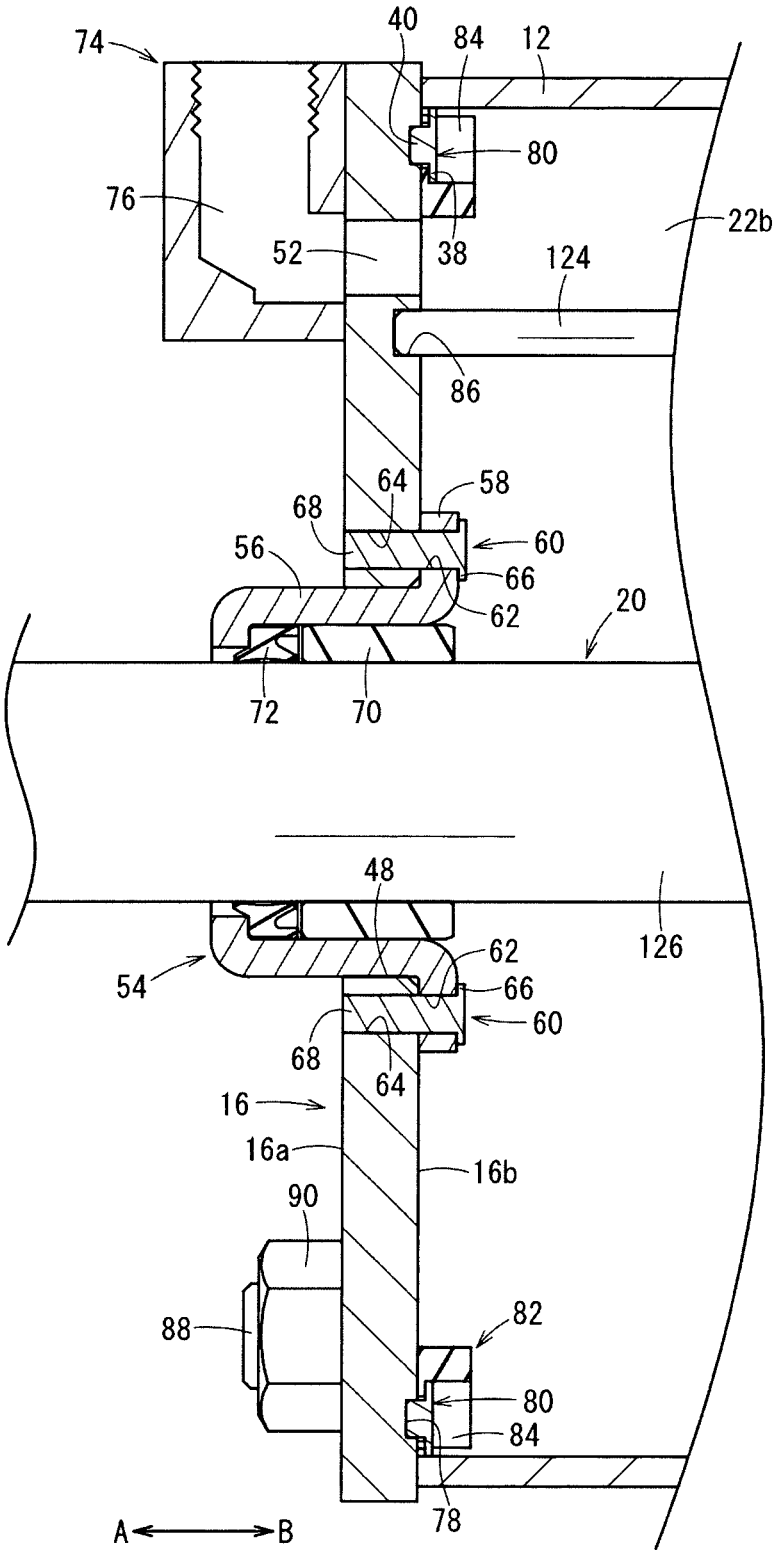
FIG. 6 is an enlarged cross-sectional view showing the vicinity of a rod cover in the fluid pressure cylinder of FIG. 1.

A holder 54 that displaceably supports the piston rod 20 is provided in the rod hole 48. As shown in FIGS. 1 and 6, for example, the holder 54 is formed by a drawing process or the like from a metal material, and includes a cylindrical holder main body 56, and a flange member 58 formed on one end of the holder main body 56 and which is expanded radially outward in diameter. A portion of the holder main body 56 is disposed so as to project outside from the rod cover 16 (see FIG. 1).

In addition, in a state in which the holder main body 56 is inserted through the rod hole 48 of the rod cover 16, and the flange member 58 is arranged on the side of the cylinder tube 12 (in the direction of the arrow B), the flange member 58 abuts against an inner wall surface 16*b* of the rod cover 16, and a plurality of (for example, four) first rivets 60 are inserted into and made to engage with first rivet holes 64 of the rod cover 16 via first through holes 62 of the flange member 58. As a result, the holder 54 is fixed with respect to the rod hole 48 of the rod cover 16. At this time, the holder 54 is fixed coaxially with the rod hole 48.

The first rivets 60, for example, are self-drilling or self-piercing rivets each having a circular flange member 66 and a shaft-shaped pin member 68, which is reduced in diameter with respect to the flange member 66. In a state with the first rivets 60 being inserted into the first through holes 62 from the side of the flange member 58, and the flange members 66 thereof engaging with the flange member 58, by punching the pin members 68 into the first rivet holes 64 of the rod cover 16, the pin members 68 are engaged with respect to the first through holes 62, and the flange member 58 is fixed with respect to the rod cover 16.

The first rivets 60 are not limited to being self-drilling rivets, and for example, may be general rivets that are fixed by having the pin members 68 thereof crushed and deformed after having been pushed out to the side of an outer wall surface 16*a* of the rod cover 16.

A bush 70 and a rod packing 72 are disposed alongside one another in the axial direction (the directions of arrows A and B) in the interior of the holder 54, and by the later-described piston rod 20 being inserted through the interior portion thereof, simultaneously with the piston rod 20 being guided along the axial direction by the bush 70, the rod packing 72 slides in contact therewith, whereby leakage of pressure fluid through a gap between the holder 54 and the rod packing 72 is prevented.

Figure 3A:
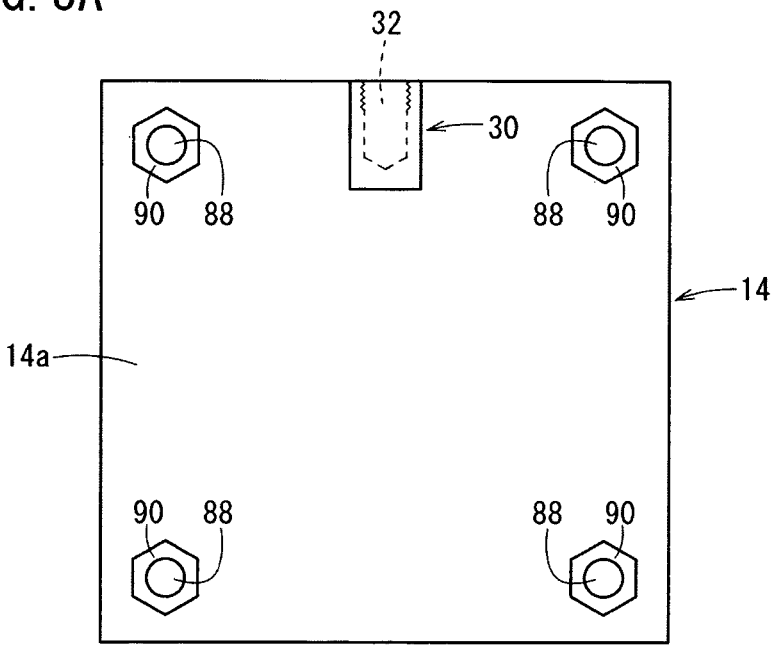
FIG. 3A is a front view as seen from a side of a head cover in the fluid pressure cylinder of FIG. 1.
Figure 3B:
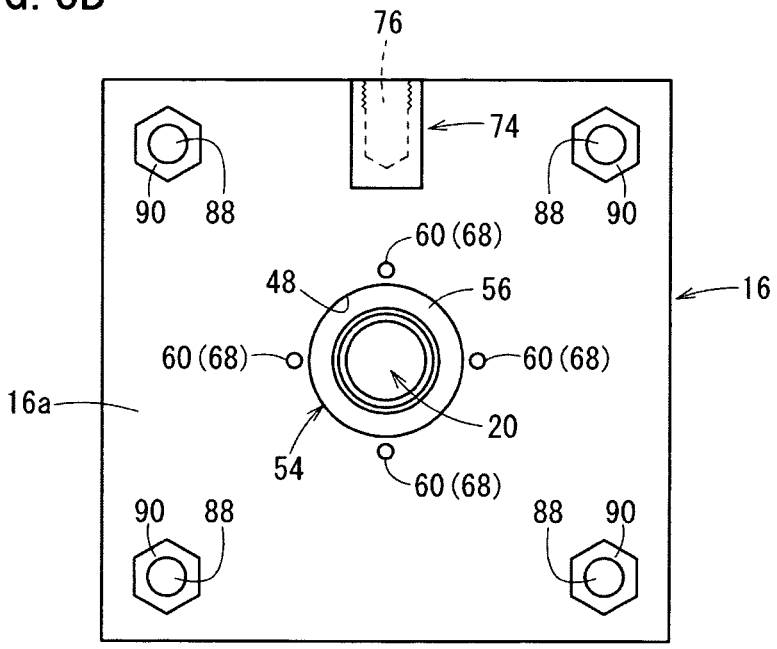
FIG. 3B is a front view as seen from a side of a rod cover in the fluid pressure cylinder of FIG. 1.

As shown in FIGS. 1, 3B, and 6, a second port member 74 from which the pressure fluid is supplied and discharged is provided on the outer wall surface 16*a* of the rod cover 16, to which a pressure fluid supply source is connected through a non-illustrated pipe. The second port member 74, for example, is constituted from a block body, which is formed from a metal material, and is fixed by welding or the like.

Further, in the interior of the second port member 74, a port passage 76, which is formed with an L-shape in cross-section, is formed, and an opening thereof is fixed with respect to the outer wall surface 16*a* of the rod cover 16 in a state of being opened in a direction perpendicular to the axial direction of the cylinder tube 12.

In addition, by the port passage 76 of the second port member 74 communicating with the second communication hole 52 of the rod cover 16, the second port member 74 and the interior of the cylinder tube 12 are placed in communication. Instead of providing the second port member 74, for example, a pipe connection fitting may be connected directly with respect to the second communication hole 52.

Figure 4B:
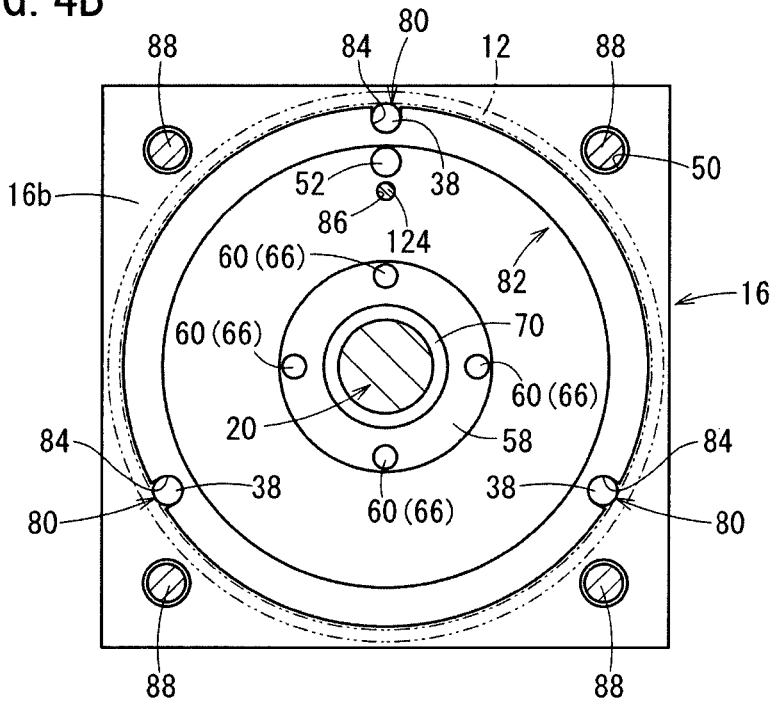
FIG. 4B is a front view shown partially in cross section of the rod cover of FIG. 3B as seen from a side of the cylinder tube.

On the other hand, on the inner wall surface 16*b* of the rod cover 16 that is formed on a side of the cylinder tube 12 (in the direction of the arrow B), as shown in FIGS. 1, 4B, and 6, a plurality of (for example, three) second pin holes 78 are formed on a circumference that is smaller in diameter than the inner circumferential diameter of the cylinder tube 12, and second spigot pins (positioning members) 80 are inserted respectively into the second pin holes 78. More specifically, the second spigot pins 80 are provided in plurality (three) in the same number as the second pin holes 78.

The second pin holes 78 are formed on a circumference having a predetermined diameter with respect to the center of the rod cover 16, and are separated by equal intervals mutually along the circumferential direction. The second spigot pins 80 are formed in the same shape as the first spigot pins 36, and therefore, detailed description thereof is omitted.

In addition, by insertion of the shaft members 40 of the second spigot pins 80 into the second pin holes 78, the second spigot pins 80 are fixed, respectively, to the inner wall surface 16*b* of the rod cover 16, and the flange members 38 thereof are in a state of projecting out with respect to the inner wall surface 16*b* of the rod cover 16.

Further, when the cylinder tube 12 is assembled with respect to the rod cover 16, as shown in FIG. 4B, the outer circumferential surfaces of the flange members 38 of the second spigot pins 80 come into internal contact with, i.e., inscribe, respectively, the inner circumferential surface of the cylinder tube 12, whereby the cylinder tube 12 is positioned with respect to the rod cover 16. More specifically, the plural second spigot pins 80 function as positioning means for positioning the other end of the cylinder tube 12 coaxially with respect to the rod cover 16.

Stated otherwise, the second spigot pins 80 are arranged on a circumference having a predetermined diameter so that the outer circumferential surfaces thereof internally contact or inscribe the inner circumferential surface of the cylinder tube 12.

Figure 7B:
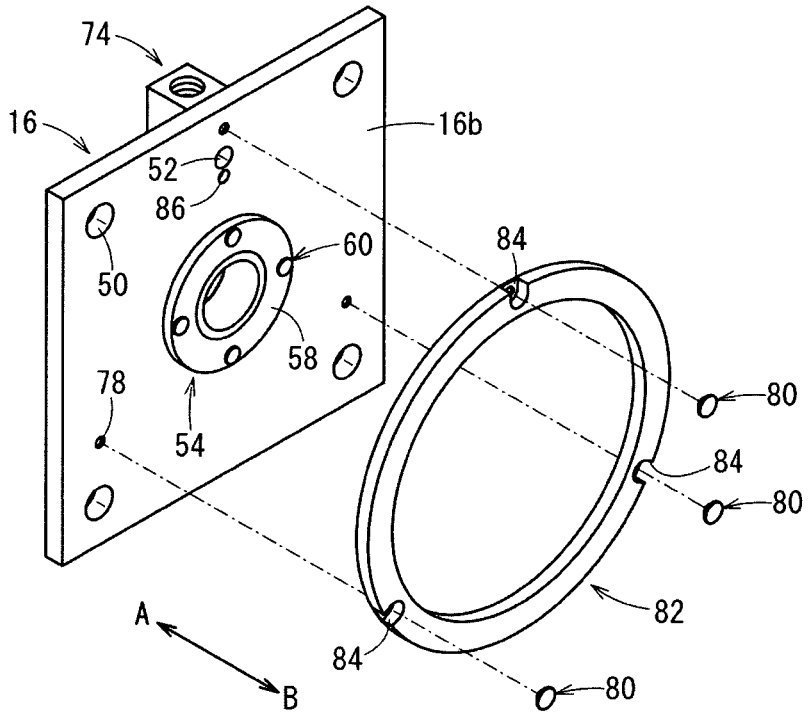
FIG. 7B is an exploded perspective view of a rod cover and a second damper shown in FIG. 4B.

A ring shaped second damper 82 is disposed on the inner wall surface 16*b* of the rod cover 16. The second damper 82, for example as shown in FIGS. 4B and 7B, is formed with a predetermined thickness from a resilient material such as rubber or the like, and the inner circumferential surface thereof is arranged more radially outward than the second communication hole 52.

Further, in the second damper 82, plural cutaway sections 84 are included, which are recessed with substantially circular shapes in cross section radially outward from the outer circumferential surface of the second damper 82, and the second spigot pins 80 are inserted through the cutaway sections 84. In addition, by the second damper 82 being sandwiched between the inner wall surface 16*b* of the rod cover 16 and the flange members 38 of the second spigot pins 80, the second damper 82 is retained in a state of projecting out at a predetermined height with respect to the inner wall surface 16*b*.

More specifically, the cutaway sections 84 are provided in the same number, at the same pitch, and on the same circumference as the second spigot pins 80.

In this manner, at the same time as functioning as positioning means (spigot means) for positioning the other end of the cylinder tube 12 at a predetermined position with respect to the rod cover 16, the second spigot pins 80 also function as fixing means for fixing the second damper 82 to the rod cover 16.

In addition, when the piston unit 18 is displaced to the side of the rod cover 16 (in the direction of the arrow A), by the end thereof coming into abutment against the second damper 82, direct contact between the piston unit 18 and the rod cover 16 is avoided, and the occurrence of shocks and impact noises accompanying such contact is suitably prevented.

Further, a second rod hole 86 in which the later-described guide rod 124 is supported is formed at a position located further toward the central side of the rod cover 16 with respect to the second communication hole 52. As shown in FIG. 1, the second rod hole 86 opens toward the side of the inner wall surface 16*b* of the rod cover 16 (in the direction of the arrow B) and does not penetrate through to the outer wall surface 16*a*.

In addition, in a state in which the one end of the cylinder tube 12 is placed in abutment against the inner wall surface 14*b* of the head cover 14 and the other end thereof is placed in abutment against the inner wall surface 16*b* of the rod cover 16, the connecting rods 88 are inserted respectively through the four first and second holes 26, 50, and fastening nuts 90 (see FIGS. 1, 3A and 3B) are screw-engaged on both ends thereof. Thereafter, the fastening nuts 90 are tightened until they come into abutment against the outer wall surfaces 14*a*, 16*a* of the head cover 14 and the rod cover 16. As a result, the cylinder tube 12 is fixed in a condition of being sandwiched and gripped between the head cover 14 and the rod cover 16.

Figure 5:
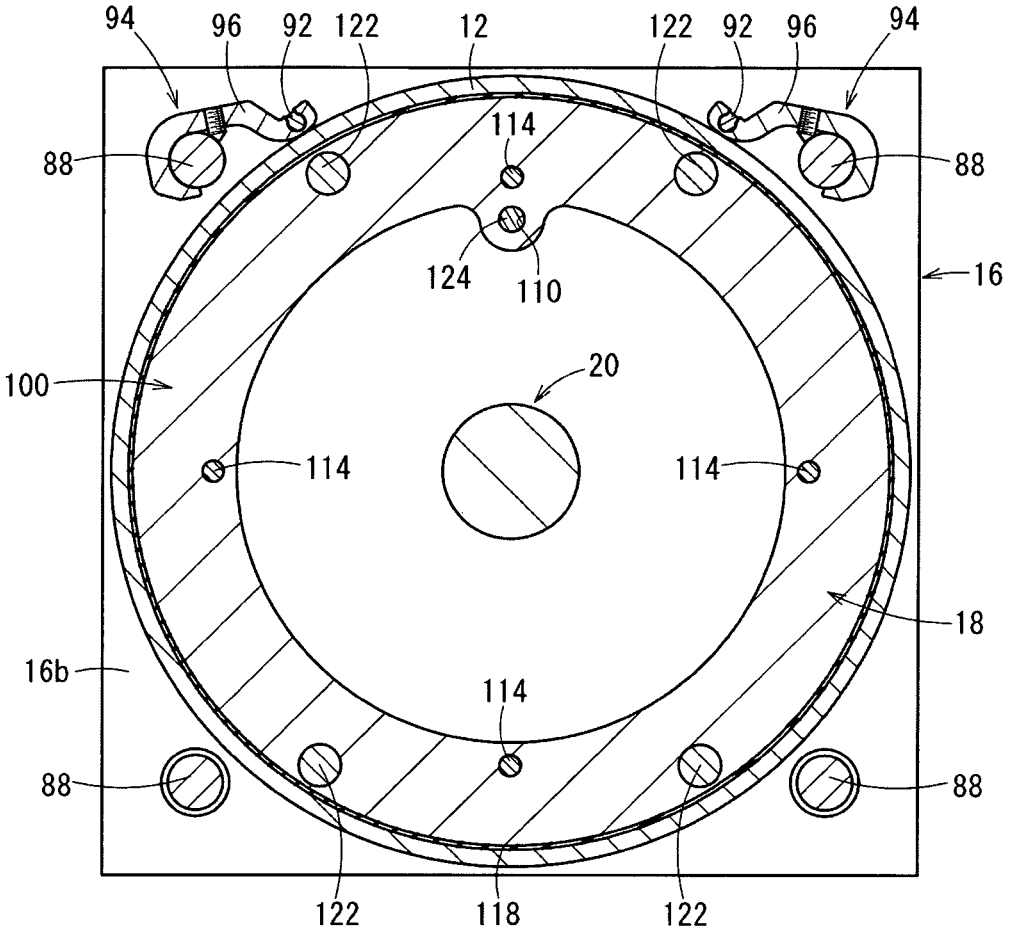
FIG. 5 is a cross-sectional view taken along line V-V of FIG. 1.

Further, as shown in FIG. 5, sensor retaining bodies 94 that hold detecting sensors 92 for detecting the position of the piston unit 18 are disposed on the connecting rods 88. The sensor retaining bodies 94 are disposed substantially perpendicular with respect to the direction of extension of the connecting rods 88, and are disposed so as to be capable of moving along the connecting rods 88, together with including mounting sections 96 that extend from the locations retained on the connecting rods 88 and in which the detecting sensors 92 are mounted. In the mounting sections 96, grooves, which are circular in cross section, for example, are formed substantially in parallel with the connecting rods 88, with the detecting sensors 92 being housed and retained in the grooves.

The detecting sensors 92 are magnetic sensors that are capable of detecting magnetism possessed by magnets 122 of a later-described ring body 100. The sensor retaining bodies 94 including the detecting sensors 92 are selectively provided at a quantity as needed.

As shown in FIGS. 1, and 2, the piston unit 18 includes a disk shaped plate body 98, which is connected to one end of the piston rod 20, and the ring body 100 connected to an outer edge portion of the plate body 98.

The plate body 98, for example, is formed with a substantially constant thickness from a metal plate member having elasticity, and a plurality of (for example, four) second through holes 102 that penetrate therethrough in the thickness direction are disposed in a central portion of the plate body 98. In addition, second rivets 104 are inserted into the second through holes 102, and by distal ends thereof being inserted into and engaged with second rivet holes 106 that are formed in the one end of the piston rod 20, the plate body 98 is connected substantially perpendicular to the one end of the piston rod 20.

The second rivets 104, for example, similar to the first rivets 60, are self-drilling rivets. After the second rivets 104 are inserted such that the flange members 66 thereof are placed on the side of the head cover 14 (in the direction of the arrow B) of the plate body 98, by punching the pin members 68 into the interior of the piston rod 20, the pin members 68 are engaged with respect to the second rivet holes 106, and the plate body 98 is fixed in engagement with respect to the piston rod 20.

Further, on an outer edge portion of the plate body 98, a plurality of (for example, four) third through holes 108 are provided that penetrate in the thickness direction. The third through holes 108 are formed at equal intervals mutually along the circumferential direction of the plate body 98, together with being formed on the same diameter with respect to the center of the plate body 98.

Furthermore, on the plate body 98, at a position more on an inner circumferential side than the third through holes 108, a rod insertion hole 110 is formed that penetrates in the thickness direction, and through which the later-described guide rod 124 is inserted.

Further still, on the plate body 98, at a position between the outer edge portion and the center portion that is fixed to the piston rod 20, for example, a rib 112 is included which has a curved shape in cross section. The rib 112 is formed in an annular shape along the circumferential direction, and is formed so as to project out toward an opposite side (in the direction of the arrow B) from the side of the piston rod 20. Further, the rib 112 may be formed to project out toward the side of the piston rod 20 (in the direction of the arrow A). Moreover, the rib 112 is formed at a position more on the inner circumferential side than the rod insertion hole 110.

The plate body 98 is not limited to the case of being connected to the end of the piston rod 20 by the second rivets 104, and for example, the plate body 98 may be connected to the end of the piston rod 20 by caulking or welding, may be connected thereto by press-contact and adhesion, or may be connected by screw-insertion. Furthermore, the plate body 98 may be connected by press-fitting of a pin into the end of the piston rod 20 and plastic deformation of the end of the pin.

The ring body 100, for example, is formed with a circular shape in cross section from a metal material, and the outer edge portion of the plate body 98 is placed in abutment against an edge portion thereof on the side of the head cover 14 (in the direction of the arrow B), and is fixed thereto by a plurality of third rivets 114. The third rivets 114, for example, similar to the first and second rivets 60, 104, are self-drilling rivets. After the third rivets 114 are inserted such that the flange members 66 thereof are placed on the side of the head cover 14 (in the direction of the arrow B) of the plate body 98, by punching the pin members 68 into third rivet holes 115 of the ring body 100, the pin members 68 are engaged and latched in the interior thereof.

Further, as shown in FIG. 2, a piston packing 116 and a wear ring 118 are disposed on the ring body 100 through annular grooves that are formed on the outer circumferential surface thereof. In addition, by the piston packing 116 sliding in contact with the inner circumferential surface of the cylinder tube 12, leakage of pressure fluid through a gap between the ring body 100 and the cylinder tube 12 is prevented. Further, by the wear ring 118 sliding in contact with the inner circumferential surface of the cylinder tube 12, the ring body 100 is guided in the axial direction (the directions of arrows A and B) along the cylinder tube 12.

Furthermore, as shown in FIGS. 1, 2, and 5, on a side surface of the ring body 100 facing toward the head cover 14, a plurality of (for example, four) holes 120, which are opened in the axial direction, are formed, and the cylindrical magnets 122 are press-fitted, respectively, into the interiors of the holes 120. The arrangement of the magnets 122 is such that, when the piston unit 18 is disposed in the interior of the cylinder tube 12, as shown in FIG. 5, the magnets 122 are disposed at positions facing toward the four connecting rods 88, and the magnetism of the magnets 122 is detected by the detecting sensors 92 of the sensor retaining bodies 94 that are provided on the connecting rods 88.

As shown in FIGS. 1, 2, and 4A through 6, the guide rod 124 is formed as a shaft with a circular shape in cross section, with one end thereof being inserted into the first rod hole 46 of the head cover 14, and the other end thereof being inserted into the second rod hole 86 of the rod cover 16, together with being inserted through the rod insertion hole 110 of the plate body 98. Owing thereto, in the interior of the cylinder tube 12, the guide rod 124 is fixed to the head cover 14 and the rod cover 16 and is disposed in parallel with the axial direction (displacement direction) of the piston unit 18, together with the piston unit 18 being prevented from undergoing rotation when the piston unit 18 is displaced in the axial direction. Stated otherwise, the guide rod 124 functions as a rotation stop for the piston unit 18.

Further, an O-ring is disposed in the rod insertion hole 110, whereby leakage of pressure fluid through a gap between the guide rod 124 and the rod insertion hole 110 is prevented.

As shown in FIG. 1, the piston rod 20 is made up from a shaft having a predetermined length along the axial direction (the directions of arrows A and B), and includes a main body portion 126 formed with a substantially constant diameter, and a small diameter distal end portion 128 formed on the other end of the main body portion 126. The distal end portion 128 is disposed so as to be exposed to the outside of the cylinder tube 12 through the holder 54. The one end of the main body portion 126 is formed in a substantially planar surface shape perpendicular to the axial direction of the piston rod 20, and is connected to the plate body 98.

The fluid pressure cylinder 10 according to the first embodiment of the present invention is constructed basically as described above. Next, operations and advantageous effects of the fluid pressure cylinder 10 will be described. A condition in which the piston unit 18 is displaced to the side of the head cover 14 (in the direction of the arrow B) will be described as an initial position.

At first, a pressure fluid is supplied to the first port member 30 from a non-illustrated pressure fluid supply source. In this case, the second port member 74 is placed in a state of being open to atmosphere under a switching operation of a non-illustrated switching valve. Consequently, the pressure fluid is supplied from the first port member 30 to the port passage 32 and the first communication hole 28, and by the pressure fluid that is supplied into the cylinder chamber 22*a* from the first communication hole 28, the piston unit 18 is pressed toward the side of the rod cover 16 (in the direction of the arrow A). In addition, the piston rod 20 is displaced while being guided in the holder 54 together with the piston unit 18, and by the end surface of the ring body 100 coming into abutment against the second damper 82, a displacement terminal end position is reached.

On the other hand, in the case that the piston unit 18 is to be displaced in the opposite direction (in the direction of the arrow B), together with the pressure fluid being supplied to the second port member 74, the first port member 30 is placed in a state of being open to atmosphere under a switching operation of the switching valve (not shown). In addition, the pressure fluid is supplied from the second port member 74 to the cylinder chamber 22*b* through the port passage 76 and the second communication hole 52, and by the pressure fluid that is supplied into the cylinder chamber 22*b*, the piston unit 18 is pressed toward the side of the head cover 14 (in the direction of the arrow B).

In addition, the piston rod 20 is displaced while being guided in the holder 54 under the displacement action of the piston unit 18, and the initial position is restored by the ring body 100 of the piston unit 18 coming into abutment against the first damper 42 of the head cover 14.

Further, when the piston unit 18 is displaced along the cylinder tube 12 in the axial direction (the directions of arrows A and B) in the manner described above, by being displaced along the guide rod 124 that is inserted through the interior of the piston unit 18, rotational displacement thereof does not take place. Therefore, the magnets 122 that are provided in the piston unit 18 are kept in positions facing toward the detecting sensors 92, and the displacement of the piston unit 18 can reliably be detected by the detecting sensors 92.

As described above, according to the first embodiment, in the head cover 14 and the rod cover 16 of the fluid pressure cylinder 10, respective pluralities of first and second spigot pins 36, 80 are disposed on the inner wall surfaces 14*b*, 16*b* that face toward the cylinder tube 12. The flange members 38 of the first and second spigot pins 36, 80 project out from the inner wall surfaces 14*b*, 16*b*, and the flange members 38 are disposed on circumferences of a predetermined diameter that internally contact or inscribe the inner circumferential surface of the cylinder tube 12. Consequently, when the cylinder tube 12 is assembled with respect to the head cover 14 and the rod cover 16, by insertion of the inner circumferential surfaces on the ends of the cylinder tube 12 so as to contact the flange members 38 of the first and second spigot pins 36, 80, the cylinder tube 12 can easily and reliably be positioned coaxially with the centers of the head cover 14 and the rod cover 16.

As a result, in the fluid pressure cylinder 10, it is possible to enhance ease of assembly of the head cover 14 and the rod cover 16 together with the cylinder tube 12.

Further, because the first and second spigot pins 36, 80 also function as fixing means for fixing the first and second dampers 42, 82 respectively onto the head cover 14 and the rod cover 16, there is no need to provide fixing bolts or the like separately from the first and second spigot pins 36, 80, and the number of parts in the fluid pressure cylinder 10 can be reduced together with enabling a reduction in the number of assembly steps therefor.

Figure 8A:
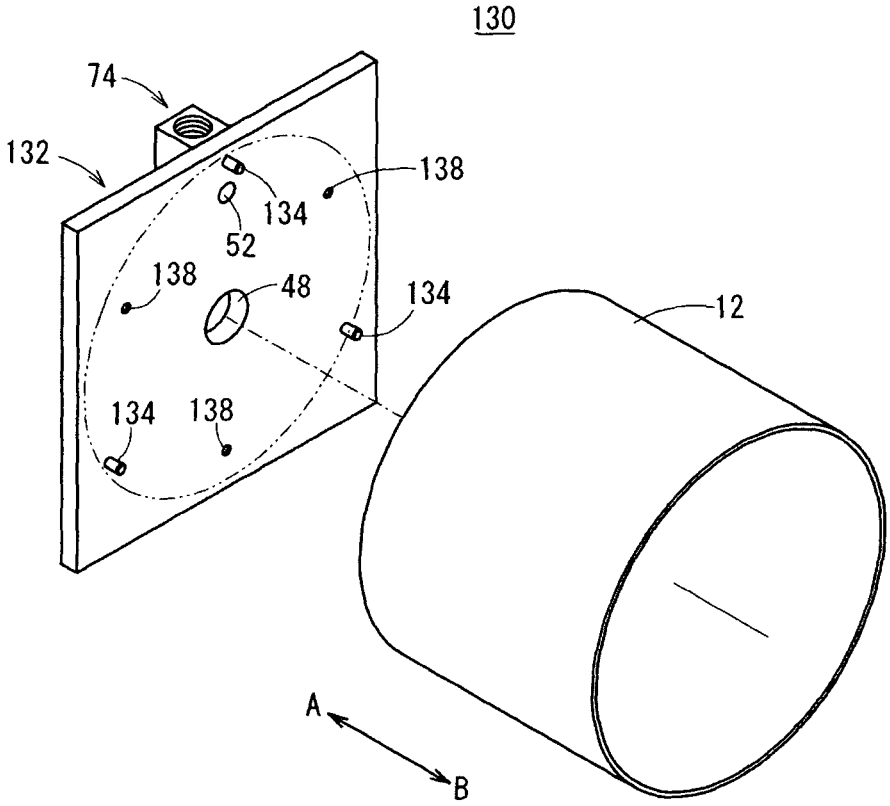
FIG. 8A is an exploded perspective view of a cylinder tube and a rod cover of a fluid pressure cylinder according to a first modification.
Figure 8B:
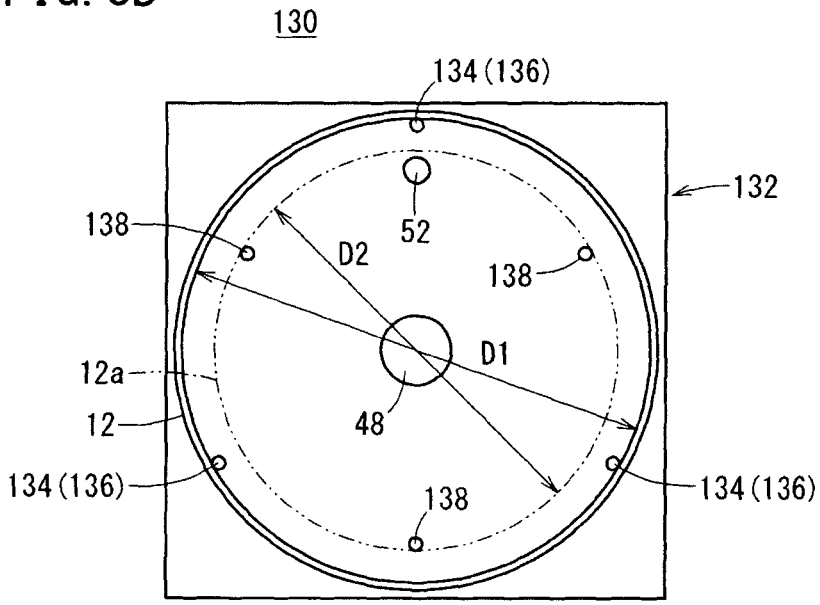
FIG. 8B is an internal front view of the rod cover shown in FIG. 8A.

On the other hand, with a fluid pressure cylinder 130 according to a first modification as shown in FIGS. 8A and 8B, for example, a plurality of (three) spigot pins 134 are disposed through first holes 136 on the inner wall surface of the rod cover 132, together with a plurality of (three) second holes 138 being formed on a circumference having a smaller diameter than the circumference on which the plurality of spigot pins 134 are arranged. More specifically, the diameter D2 of the circumference on which the second holes 138 are provided is smaller than the diameter D1 of the circumference on which the first holes 136 are formed (in FIG. 8B, D2<D1).

In addition, by taking out the spigot pins 134 that are installed in the first holes 136 and installing them instead in the second holes 138, it is possible for a cylinder tube 12*a* (the two-dot-dashed line shape shown in FIG. 8B) having a smaller diameter than the cylinder tube 12 to be inscribed, positioned and assembled with respect to the spigot pins 134. Stated otherwise, on a single rod cover 132, by changing the installation positions of the spigot pins 134, two types of cylinder tubes 12, 12*a* of different diameters can be positioned and assembled on the same axis.

Moreover, the spigot pins 134 are easily attached and detached by being constituted to be screw-engaged with respect to the first and second holes 136, 138.

Figure 9A:
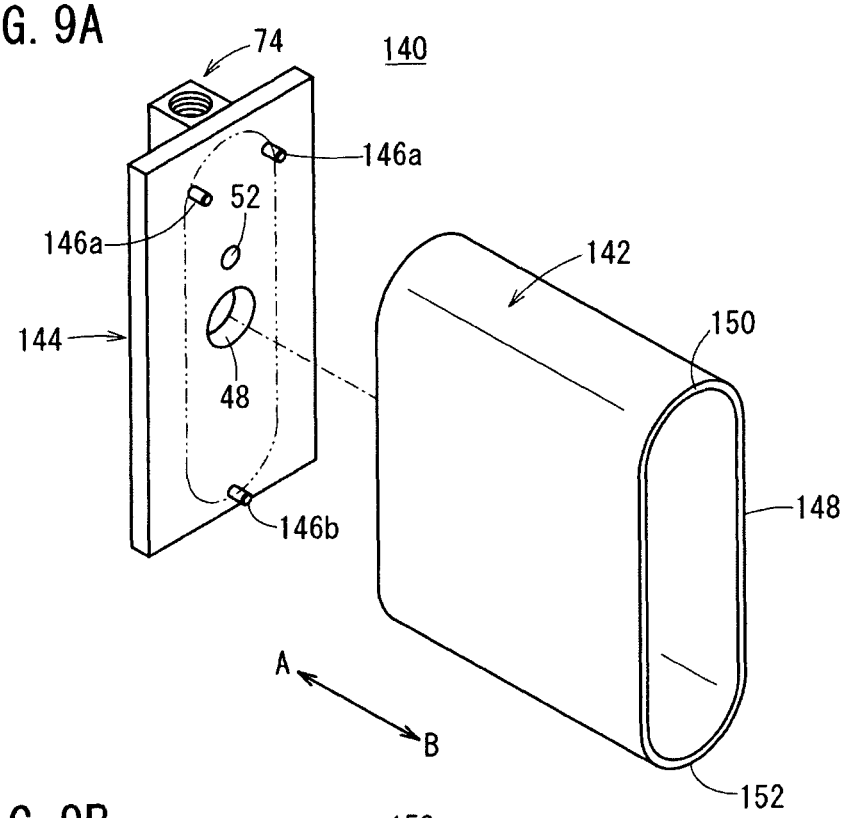
FIG. 9A is an exploded perspective view of a cylinder tube and a rod cover of a fluid pressure cylinder according to a second modification.
Figure 9B:
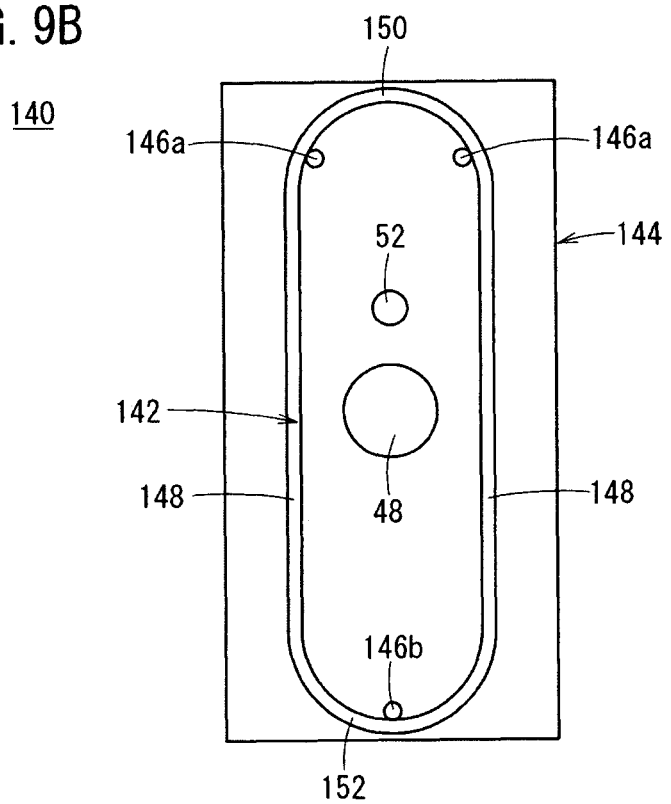
FIG. 9B is an internal front view of the rod cover shown in FIG. 9A.

Further, in the case of a fluid pressure cylinder 140 according to a second modification in which, for example, the cylinder tube does not have a circular cross-sectional shape, but rather, as shown in FIGS. 9A and 9B, a cylinder tube 142 is provided having an oblong shape in cross section, on the inner wall surface of a rod cover 144, two spigot pins 146*a* are disposed on an upper side in the vicinity of the second port member 74, whereas one spigot pin 146*b* is disposed on a lower side. The cross-sectional shape of the cylinder tube 142 is made up from a pair of planar sections 148 formed in straight shapes, a first semicircular section 150 formed on one end of the planar sections 148, and a second semicircular section 152 formed on another end of the planar sections 148.

In addition, when one end of the cylinder tube 142 is assembled with respect to the rod cover 144, the first semicircular section 150 is inserted over the outer side of the two spigot pins 146*a*, whereas the second semicircular section 152 is inserted over the outer side of the remaining one spigot pin 146*b*. Consequently, the spigot pins 146*a*, 146*b* internally contact or inscribe the inner circumferential surfaces of the first and second semicircular sections 150, 152, respectively, and are assembled in a state of being positioned coaxially with the rod hole 48 of the rod cover 144.

More specifically, with the fluid pressure cylinder 140, the three spigot pins 146*a*, 146*b* are provided, which are arranged corresponding to the cross-sectional oblong shape of the cylinder tube 142, and by assembling the first and second semicircular sections 150, 152 of the cylinder tube 142 so as to be inscribed by the spigot pins 146*a*, 146*b*, it is possible for the cylinder tube 142 to be positioned easily and reliably with respect to the rod cover 144.

Figure 10A:
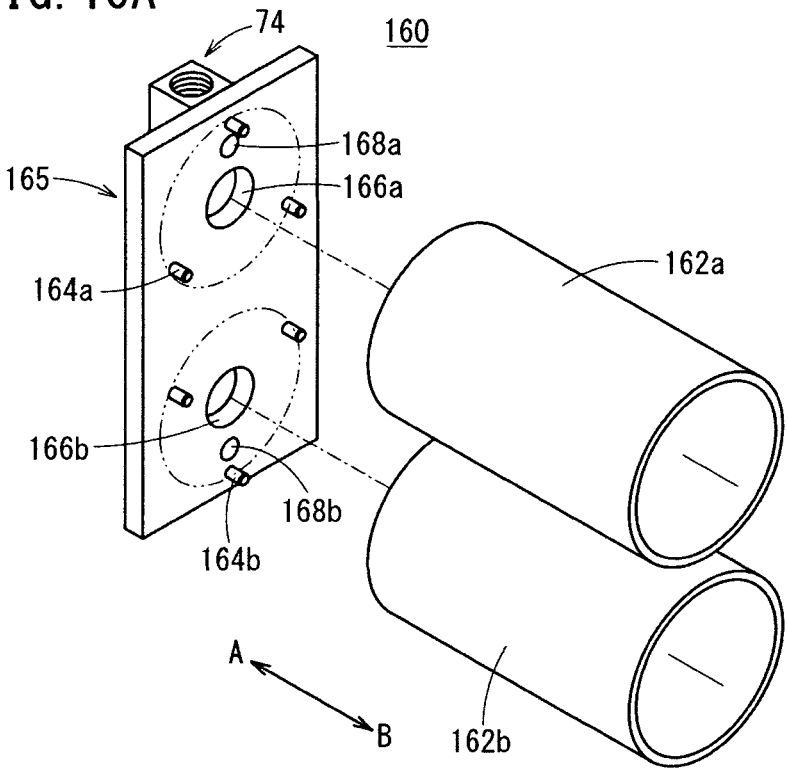
FIG. 10A is an exploded perspective view of a cylinder tube and a rod cover of a fluid pressure cylinder according to a third modification.
Figure 10B:
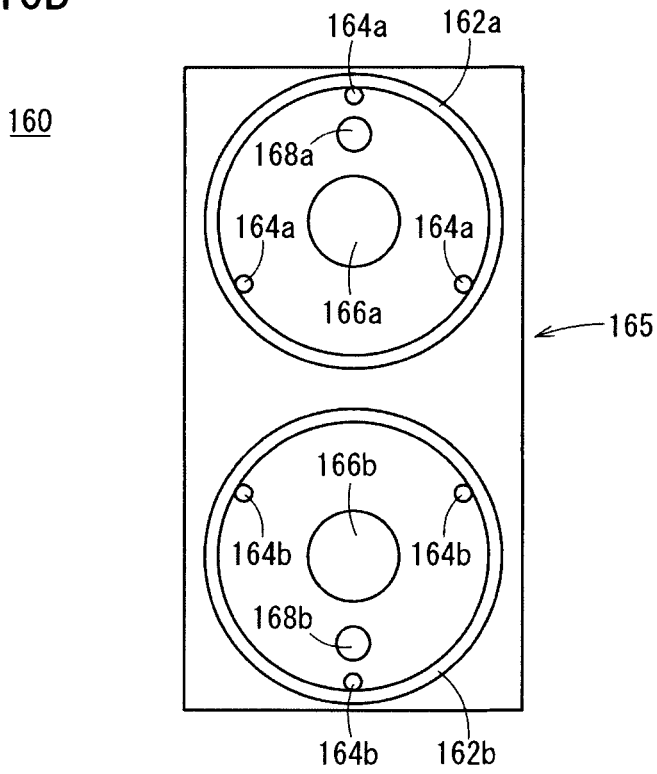
FIG. 10B is an internal front view of the rod cover shown in FIG. 10A.

Further, in the case of a twin-cylinder type of fluid pressure cylinder 160 according to a third modification as shown in FIGS. 10A and 10B, a pair of cylinder tubes 162*a*, 162*b* with circular shapes in cross section are disposed substantially in parallel, and a plurality of spigot pins 164*a*, 164*b* corresponding to the cylinder tubes 162*a*, 162*b* are disposed respectively on the inner wall surface of a rod cover 165. Further, in the rod cover 165, rod holes 166*a*, 166*b* through which piston rods (not shown) are inserted are formed respectively on the centers of circumferences on which the spigot pins 164*a*, 164*b* are arranged respectively.

Furthermore, between the rod holes 166*a*, 166*b* and the spigot pins 164*a*, 164*b*, communication holes 168*a*, 168*b* for supplying a pressure fluid into the interiors of the cylinder tubes 162*a*, 162*b* are formed respectively, and communicate with the second port member 74 (see FIG. 10A).

Additionally, non-illustrated pistons are disposed displaceably in the interiors of the pair of cylinder tubes 162*a*, 162*b*, and are displaced along the axial directions by the pressure fluid, which is supplied to the communication holes 168*a*, 168*b* from the second port member 74.

With the above-described fluid pressure cylinder 160, when the ends of the cylinder tubes 162*a*, 162*b* are assembled with respect to the rod cover 165, the cylinder tubes 162*a*, 162*b* are inserted over the outer sides of the three spigot pins 164*a*, 164*b*, and by the spigot pins 164*a*, 164*b* abutting against the inner circumferential surfaces thereof, the cylinder tubes 162*a*, 162*b* are assembled and positioned, respectively, easily and reliably in a coaxial manner with the pair of rod holes 166*a*, 166*b* in the rod cover 165.

Figure 11A:
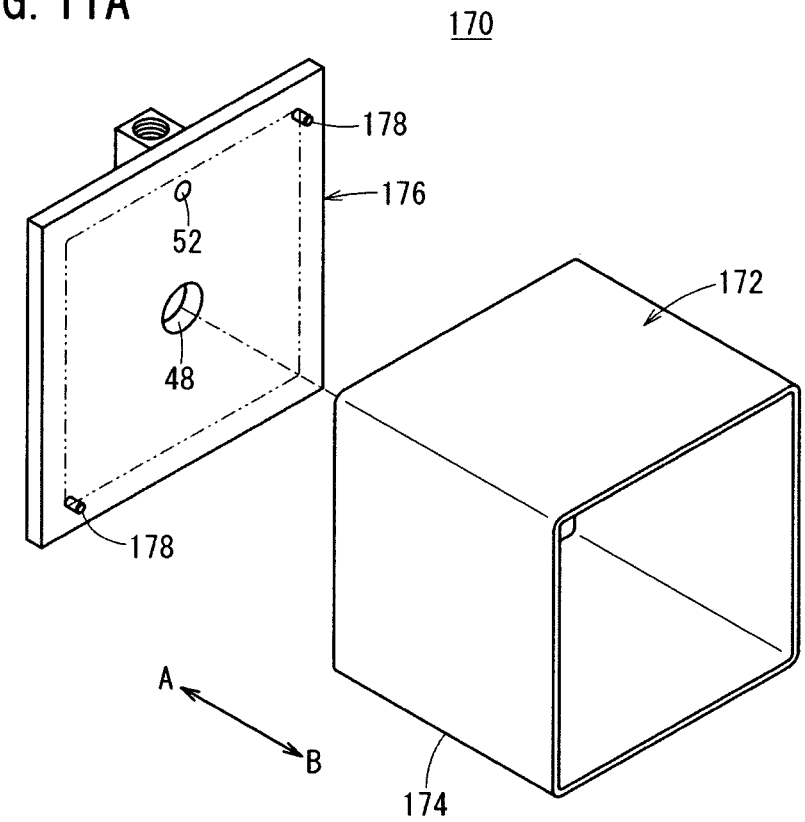
FIG. 11A is an exploded perspective view of a cylinder tube and a rod cover of a fluid pressure cylinder according to a fourth modification.
Figure 11B:
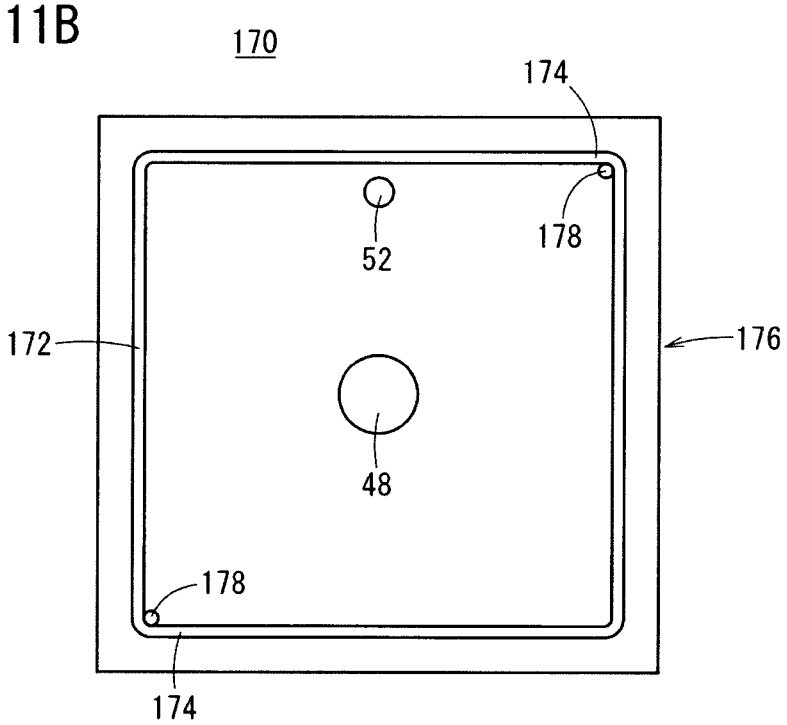
FIG. 11B is an internal front view of the rod cover shown in FIG. 11A.

Furthermore, in the case of a fluid pressure cylinder 170 having a cylinder tube 172 having a rectangular shape in cross section according to a fourth modification as shown in FIGS. 11A and 11B, two spigot pins 178 are disposed on the inner wall surface of a rod cover 176, so as to internally contact two diagonal corners 174, among the four corners 174 of the cylinder tube 172. Consequently, when the cylinder tube 172 is assembled with respect to the rod cover 176, by the two spigot pins 178 being placed in internal contact with the diagonal inner wall surfaces of the cylinder tube 172, the cylinder tube 172 is easily and reliably assembled and positioned coaxially with the rod hole 48 of the rod cover 176.

In the respective modified examples described above, although descriptions have been made for cases in which the cylinder tubes 12, 142, 162*a*, 162*b*, and 172 are positioned and assembled with respect to the rod covers 132, 144, 165, and 176, a similar situation applies to the case of being assembled with respect to the head cover 14.

Next, a fluid pressure cylinder 180 according to a second embodiment will be described with reference to FIGS. 12A and 12B. Constituent elements thereof, which are the same as those of the fluid pressure cylinder 10 according to the aforementioned first embodiment, are designated by the same reference characters, and detailed description of such features is omitted.

Figure 12A:
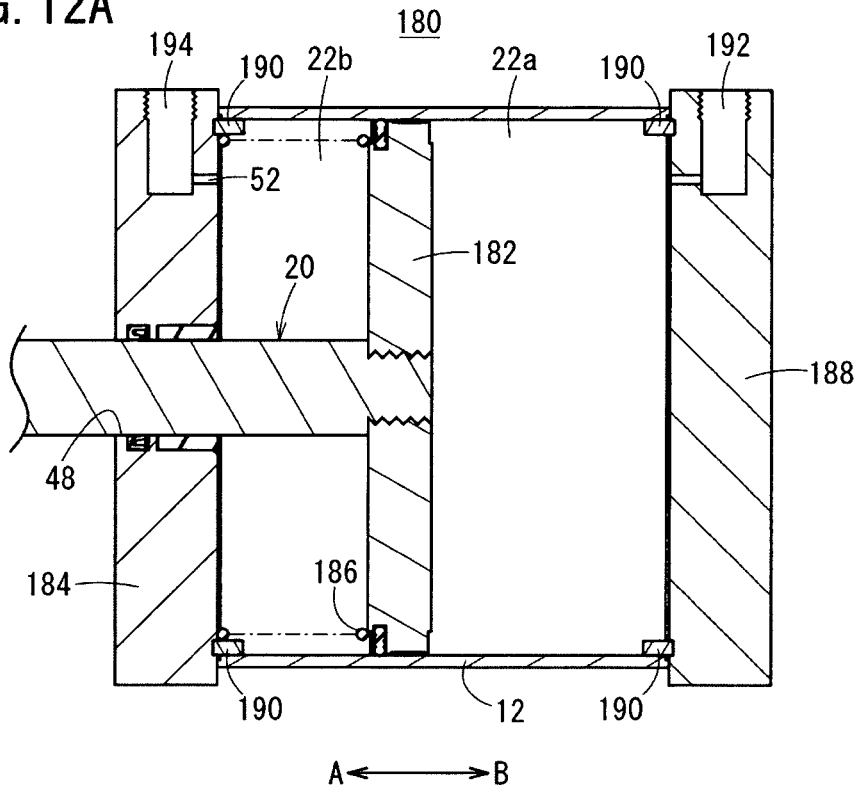
FIG. 12A is a cross-sectional view with partial omission of a fluid pressure cylinder according to a second embodiment.
Figure 12B:
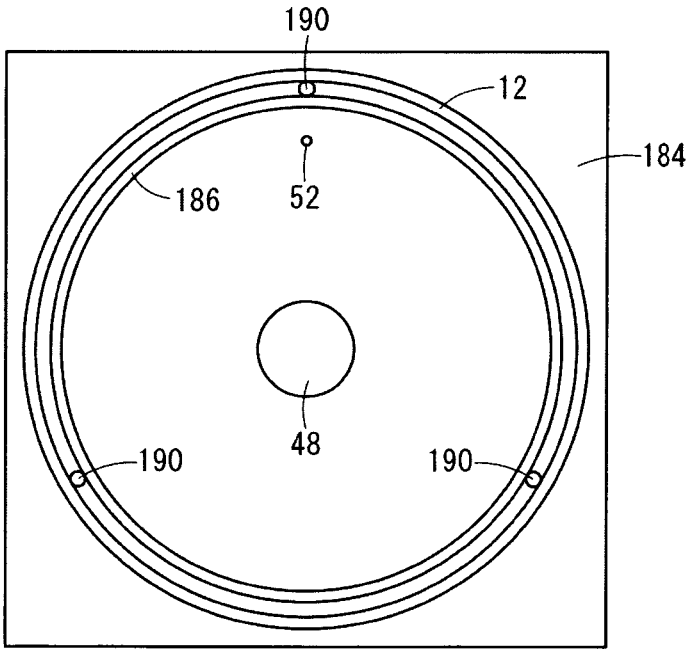
FIG. 12B is an internal front view of a rod cover in the fluid pressure cylinder of FIG. 12A.

As shown in FIG. 12A, the fluid pressure cylinder 180 is a single-acting type of fluid pressure cylinder, in which a spring 186 is disposed between a piston 182 and a rod cover 184. With the fluid pressure cylinder 180, the cylinder tube 12 is positioned coaxially and connected mutually with the piston 182 and the piston rod 20 by plural spigot pins 190, which are disposed respectively on inner wall surfaces of a head cover 188 and the rod cover 184. The spring 186, for example, is made up from a coil spring, and possesses a resilient force that urges the piston 182 toward the side of the head cover 188 (in the direction of the arrow B).

In addition, with the fluid pressure cylinder 180, the pressure fluid from a first port 192 of the head cover 188 is supplied to the cylinder chamber 22*a*, whereby the piston 182 is displaced toward the side of the rod cover 184 (in the direction of the arrow A) in opposition to the elastic force of the spring 186. On the other hand, by stopping supply of the pressure fluid to the first port 192 and placing the first port 192 in a condition of being open to atmosphere, the piston 182 is displaced toward the side of the head cover 188 (in the direction of the arrow B) by the elastic force of the spring 186. Moreover, at this time, the pressure fluid may also be supplied to a second port 194 of the rod cover 184.

Even with the single-acting fluid pressure cylinder 180 of this type, by assembling the cylinder tube 12 using the spigot pins 190, which are disposed on inner wall surfaces of the head cover 188 and the rod cover 184, it is possible to position and assemble the cylinder tube 12 easily and reliably on the same axis with respect to the head cover 188 and the rod cover 184. Further, it should be noted that the spring 186 may be arranged on the side of the head cover 188.

Next, a fluid pressure cylinder 200 according to a third embodiment will be described with reference to FIG. 13. Constituent elements thereof, which are the same as those of the fluid pressure cylinders 10, 180 according to the aforementioned first and second embodiments, are designated by the same reference characters, and detailed description of such features is omitted.

Figure 13:
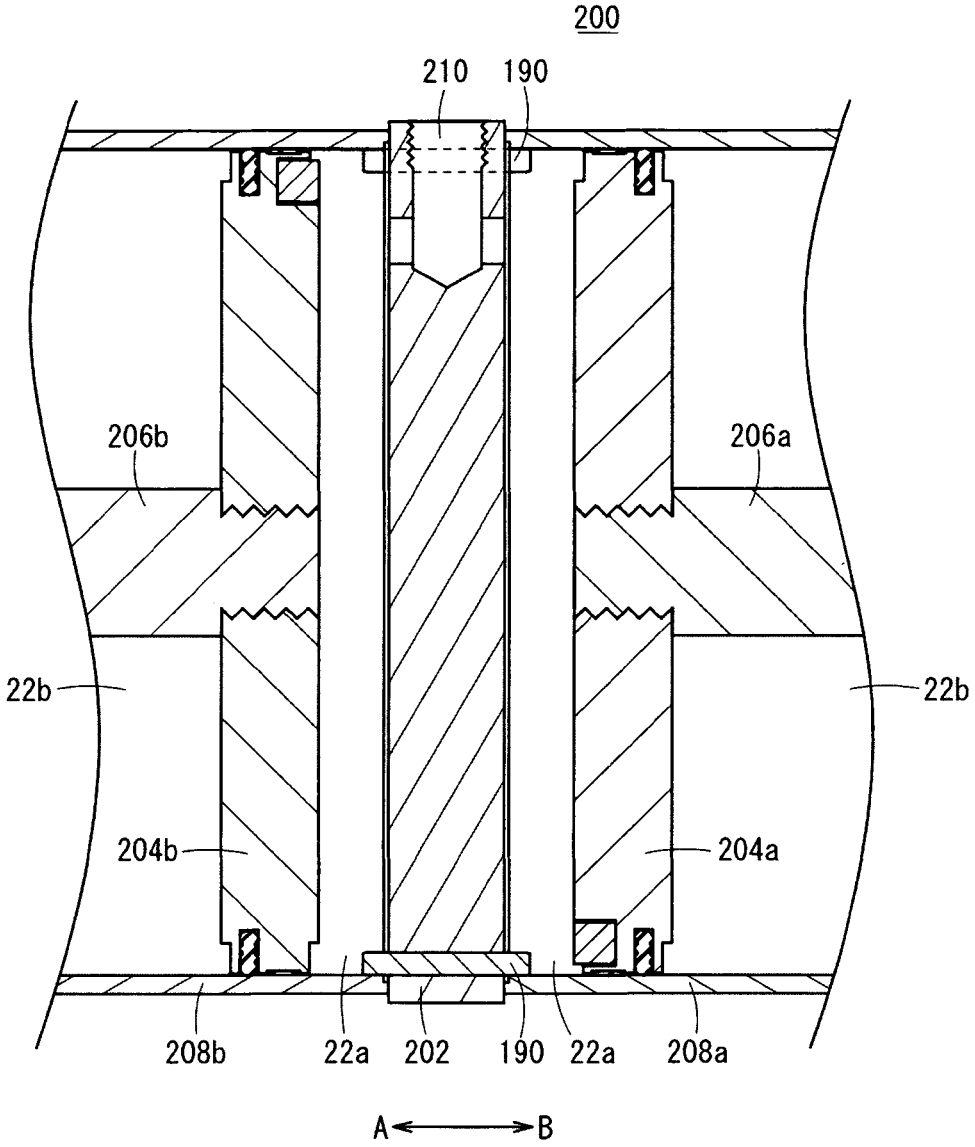
FIG. 13 is a cross-sectional view with partial omission of a fluid pressure cylinder according to a third embodiment.

As shown in FIG. 13, the fluid pressure cylinder 200 is a dual rod type of fluid pressure cylinder including on both sides of a base plate 202 respective pairs of pistons 204*a*, 204*b*, piston rods 206*a*, 206*b*, and cylinder tubes 208*a*, 208*b*, with the base plate 202 being sandwiched therebetween. With such a fluid pressure cylinder 200, plural spigot pins 190 are disposed respectively on both side surfaces of the base plate 202. The other end side of one of the cylinder tubes 208*a*, and the one end side of the other of the cylinder tubes 208*b* are positioned respectively by the spigot pins 190.

The spigot pins 190 penetrate through the base plate 202, such that both end portions thereof project out respectively on the side of the cylinder tube 208*a*, and on the side of the cylinder tube 208*b*.

In addition, with the fluid pressure cylinder 200, from a port 210 of the base plate 202, the pressure fluid is supplied respectively to the cylinder chambers 22*a*, 22*b* of the cylinder tubes 208*a*, 208*b*, whereby the two pistons 204*a*, 204*b* in pairs are displaced respectively in directions away from the base plate 202.

Even with the dual rod fluid pressure cylinder 200 of this type, by assembling the cylinder tubes 208*a*, 208*b* using the spigot pins 190, which are disposed on both side surfaces of the base plate 202, it is possible to position and assemble the cylinder tubes 208*a*, 208*b* easily and reliably with respect to the base plate 202.

Further, because the spigot pins 190 for positioning the one cylinder tube 208*a*, and the spigot pins 190 for positioning the other cylinder tube 208*b* are used in common, compared to the case of providing spigot pins separately and respectively, the number of parts in the fluid pressure cylinder 200 can be reduced, together with enabling a reduction in the number of assembly steps.

Next, a fluid pressure cylinder 220 according to a fourth embodiment will be described with reference to FIGS. 14A and 14B. Constituent elements thereof, which are the same as those of the fluid pressure cylinders 10, 180, 200 according to the aforementioned first through third embodiments, are designated by the same reference characters, and detailed description of such features is omitted.

Figure 14A:
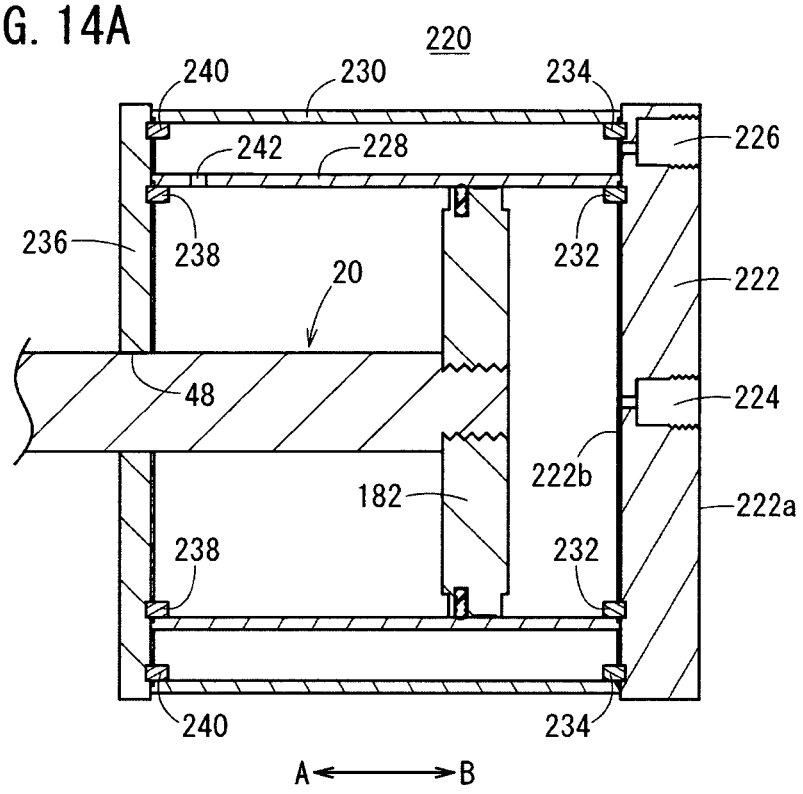
FIG. 14A is a cross-sectional view with partial omission of a fluid pressure cylinder according to a fourth embodiment.
Figure 14B:
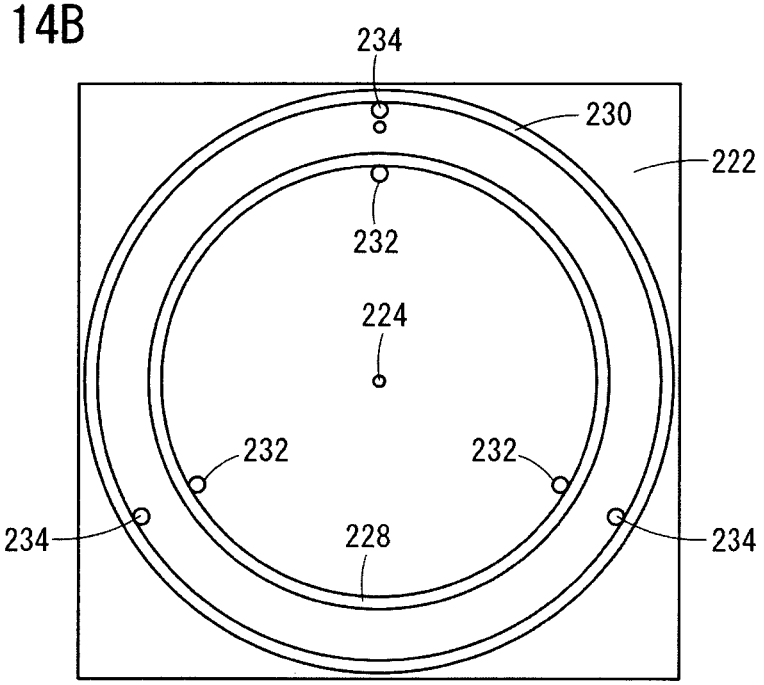
FIG. 14B is an internal front view of a head cover in the fluid pressure cylinder of FIG. 14A.

As shown in FIG. 14A, the fluid pressure cylinder 220 differs from the fluid pressure cylinders 10, 180, 200 according to the first through third embodiments, in that first and second ports 224, 226 are included on a head cover 222, and a pair of first and second cylinder tubes 228, 230 are included in the form of a double tube.

On the head cover 222, there are included the first port 224, which opens in the center of an outer wall surface 222*a* thereof, and the second port 226, which opens in the vicinity of an outer edge portion of the outer wall surface 222*a*. The first and second ports 224, 226 are formed substantially in parallel and penetrate in the thickness direction of the head cover 222.

Stated otherwise, the first and second ports 224, 226 are formed along the axial direction (the directions of arrows A and B) of the fluid pressure cylinder 220.

Further, plural first spigot pins 232 for positioning the first cylinder tube 228, together with plural second spigot pins 234 for positioning the second cylinder tube 230, which covers the outer circumferential side of the first cylinder tube 228, are provided on an inner wall surface 222*b* of the head cover 222.

On the other hand, on the inner circumferential surface of a rod cover 236, third spigot pins 238 are provided on a circumference having the same diameter as the first spigot pins 232 on the head cover 222, and fourth spigot pins 240 are provided on a circumference having the same diameter as the second spigot pins 234 on the head cover 222.

In addition, by insertion of both ends of the first cylinder tube 228 respectively over the first spigot pins 232 of the head cover 222 and the third spigot pins 238 of the rod cover 236, the first and third spigot pins 232, 238 are positioned so as to internally contact or inscribe the inner circumferential surface of the first cylinder tube 228.

Further, by insertion of both ends of the second cylinder tube 230 respectively over the second spigot pins 234 of the head cover 222 and the fourth spigot pins 240 of the rod cover 236, the second and fourth spigot pins 234, 240 are positioned so as to internally contact or inscribe the inner circumferential surface of the second cylinder tube 230.

Consequently, the first cylinder tube 228 is positioned coaxially with respect to the inner wall surfaces of the head cover 222 and the rod cover 236, and on the outer side of the first cylinder tube 228, the second cylinder tube 230 is positioned coaxially with respect to the inner wall surfaces of the head cover 222 and the rod cover 236.

In addition, in the fluid pressure cylinder 220, by supplying the pressure fluid from the first port 224 to the interior of the first cylinder tube 228, the piston 182 is displaced toward the side of the rod cover 236 (in the direction of the arrow A), whereas by supplying the pressure fluid between the second cylinder tube 230 and the first cylinder tube 228 from the second port 226, the pressure fluid is introduced through a communication port 242 (see FIG. 14A) that opens on the circumferential wall of the first cylinder tube 228, between the piston 182 and the rod cover 236, and the piston 182 is pressed toward the side of the head cover 222 (in the direction of the arrow B).

Even with the fluid pressure cylinder 220 as described above, in which supply and discharge of the pressure fluid can be carried out from the side of the head cover 222, by disposing the two types of spigot pins 232, 234, 238, 240 on circumferences, each having different circumferential diameters, with respect to the head cover 222 and the rod cover 236, it is possible to position and assemble the first and second cylinder tubes 228, 230, which differ in diameter, easily and reliably on the same axis.

Next, a fluid pressure cylinder 250 according to a fifth embodiment will be described with reference to FIGS. 15A and 15B. Constituent elements thereof, which are the same as those of the fluid pressure cylinders 10, 180, 200, 220 according to the aforementioned first through fourth embodiments, are designated by the same reference characters, and detailed description of such features is omitted.

Figure 15A:
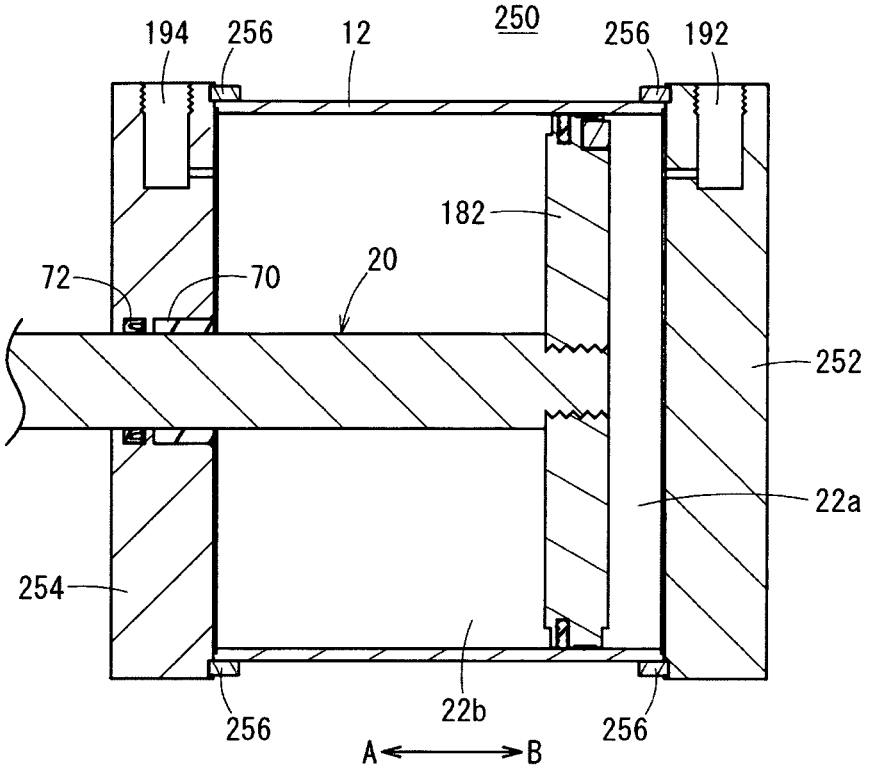
FIG. 15A is a cross-sectional view with partial omission of a fluid pressure cylinder according to a fifth embodiment.
Figure 15B:
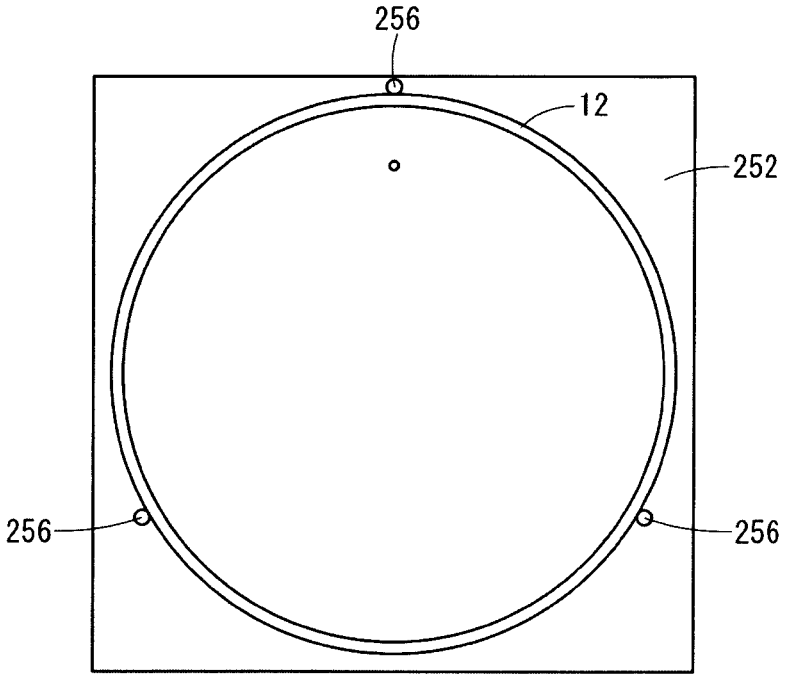
FIG. 15B is an internal front view of a head cover in the fluid pressure cylinder of FIG. 15A.

As shown in FIGS. 15A and 15B, the fluid pressure cylinder 250 differs from the fluid pressure cylinders 10, 180, 200, 220 according to the first through fourth embodiments, in that the outer circumferential surface of the cylinder tube 12 is retained by a plurality of spigot pins 256 that are provided on the inner wall surfaces of a head cover 252 and a rod cover 254.

As in the fluid pressure cylinder 250 described above, even in the case of providing the plural spigot pins 256 that contact the outer circumferential surface of the cylinder tube 12, it is possible to position and assemble the cylinder tube 12 easily and reliably on the same axis with respect to the head cover 252 and the rod cover 254.

Lastly, a fluid pressure cylinder 260 according to a sixth embodiment will be described with reference to FIGS. 16A and 16B. Constituent elements thereof, which are the same as those of the fluid pressure cylinders 10, 180, 200, 220, 250 according to the aforementioned first through fifth embodiments, are designated by the same reference characters, and detailed description of such features is omitted.

Figure 16A:
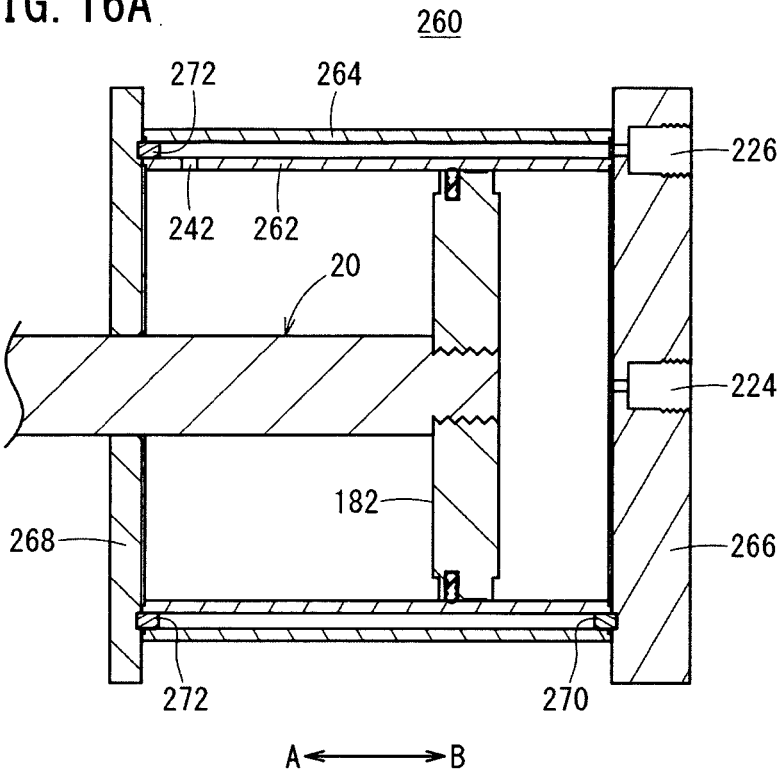
FIG. 16A is a cross-sectional view with partial omission of a fluid pressure cylinder according to a sixth embodiment.

As shown in FIG. 16A, the fluid pressure cylinder 260 differs from the fluid pressure cylinder 220 according to the fourth embodiment, in that first and second cylinder tubes 262, 264 that make up a double pipe are positioned and retained together by a plurality of first spigot pins 270 provided on a head cover 266, and a plurality of second spigot pins 272 are provided on a rod cover 268.

Figure 16B:
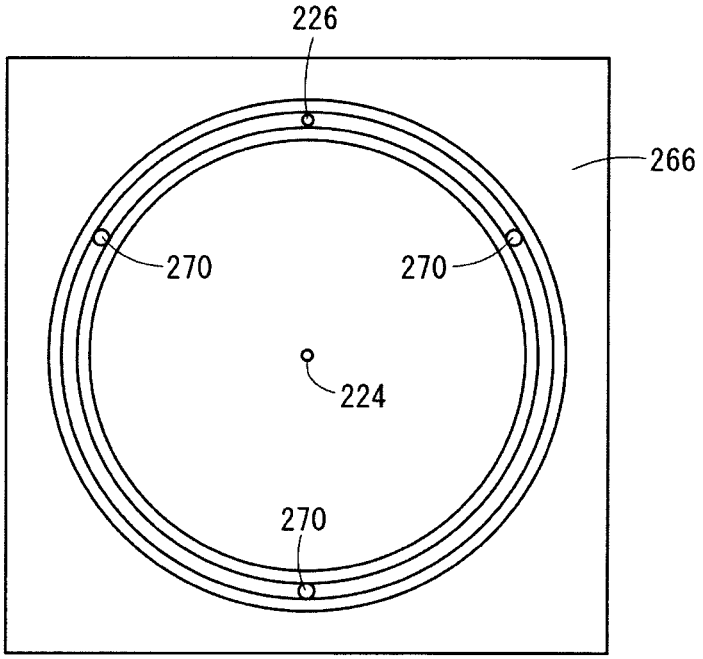
FIG. 16B is an internal front view of a head cover in the fluid pressure cylinder of FIG. 16A.

On the head cover 266, as shown in FIGS. 16A and 16B, there are included the first port 224, which opens in the center of an outer wall surface thereof, and the second port 226, which opens in the vicinity of an outer edge portion of the outer wall surface, and for example, the plurality of first spigot pins 270 are disposed on the same circumference as the second port 226. On the other hand, on the rod cover 268, the plurality of second spigot pins 272 are disposed on a circumference having the same diameter as the first spigot pins 270.

Both ends of the first cylinder tube 262 are arranged on inner sides of the first and second spigot pins 270, 272, and the outer circumferential surface thereof is positioned and retained coaxially by abutting against the first and second spigot pins 270, 272. On the other hand, the second cylinder tube 264 is arranged on the outer circumferential side of the first cylinder tube 262, with both ends thereof being arranged on outer sides of the first and second spigot pins 270, 272, and the inner circumferential surface thereof is positioned and retained coaxially by abutting against the first and second spigot pins 270, 272.

Consequently, the first cylinder tube 262 is positioned coaxially with respect to the head cover 266 and the rod cover 268, and further, the second cylinder tube 264 is positioned coaxially on the outer circumferential side of the first cylinder tube 262.

More specifically, the first and second spigot pins 270, 272 comprise both means for positioning the first cylinder tube 262 and means for positioning the second cylinder tube 264.

In the foregoing manner, in the fluid pressure cylinder 260 equipped with the pair of first and second cylinder tubes 262, 264, without providing two types of spigot pins respectively on the head cover 266 and the rod cover 268, since the pair of first and second cylinder tubes 262, 264 can be positioned and maintained by only one type of first and second spigot pins 270, 272, the number of parts in the fluid pressure cylinder 260 can be reduced, together with enabling a reduction in the number of assembly steps.

The fluid pressure cylinder according to the present invention is not limited to the above embodiments. It is a matter of course that various changes and modifications may be made to the embodiments without departing from the scope of the invention as set forth in the appended claims.

The invention claimed is:

1. A fluid pressure cylinder comprising:

a tubular shaped cylinder tube including cylinder chambers defined in interior thereof;

a cover member attached to an end of the cylinder tube; and a piston disposed displaceably along the cylinder chambers;

wherein, on an end surface of the cover member, a positioning member is provided that abuts against at least one of an inner wall surface or an outer wall surface of the cylinder tube, and positions the cylinder tube coaxially with respect to the cover member, wherein the positioning member comprises pins, which project with respect to a wall surface of the cover member toward a side of the cylinder tube and which directly contact the cylinder tube, wherein the pins are provided in a quantity or at least two or more.

2. The fluid pressure cylinder according to claim 1, further comprising holes for installation of the positioning member therein, the holes being arranged in a shape corresponding to the cross-sectional shape of the cylinder tube.

3. The fluid pressure cylinder according to claim 1, wherein a plurality of the cylinder tubes are provided, an inner wall surface on one of the cylinder tubes abutting against the positioning member, and an outer wall surface of another of the cylinder tubes abutting against the positioning member.

4. The fluid pressure cylinder according to claim 1, wherein the positioning member fixes a damper member with respect to the cover member, wherein the damper member is configured to buffer shocks when the piston is displaced to a side of the cover member.

* * * * *